US007478516B2

(12) United States Patent
Higer et al.

(10) Patent No.: US 7,478,516 B2
(45) Date of Patent: Jan. 20, 2009

(54) VACUUM PACKAGING APPLIANCE

(75) Inventors: Landen Higer, Alameda, CA (US); Charles Wade Albritton, Hercules, CA (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 11/385,133

(22) Filed: Mar. 20, 2006

(65) Prior Publication Data

US 2006/0230711 A1 Oct. 19, 2006

Related U.S. Application Data

(63) Continuation-in-part of application No. 10/909,971, filed on Jul. 30, 2004, now Pat. No. 7,200,974.

(60) Provisional application No. 60/492,035, filed on Jul. 31, 2003, provisional application No. 60/492,090, filed on Jul. 31, 2003.

(51) Int. Cl.
*B65B 31/02* (2006.01)

(52) U.S. Cl. ..... 53/512; 53/405; 53/434; 53/84

(58) Field of Classification Search ..... 53/432, 53/510, 79, 84, 85, 86, 374.8, 375.6, 512, 53/434, 405; 99/467, 472; 426/404
See application file for complete search history.

(56) References Cited

U.S. PATENT DOCUMENTS

| | | | |
|---|---|---|---|
| 1,143,579 | A | 6/1915 | Denhard |
| 1,346,435 | A | 7/1920 | Worster |
| 1,521,203 | A | 12/1924 | Roehrig |
| 2,079,069 | A | 5/1937 | Johnson |
| 2,270,332 | A | 1/1942 | Osborn, Jr. |
| 2,270,469 | A | 1/1942 | Osborn, Jr. |
| 2,319,011 | A | 5/1943 | Meredith |
| 2,354,423 | A | 7/1944 | Rosenberger |
| 2,421,149 | A | 5/1947 | Hard et al. |
| 2,506,362 | A | 5/1950 | Hofmann |
| 2,568,226 | A | 9/1951 | Drake |
| 2,617,304 | A | 11/1952 | Conover |

(Continued)

FOREIGN PATENT DOCUMENTS

DE 3632723 A1 3/1988

(Continued)

OTHER PUBLICATIONS

"Vacuum Seal-A-Meal Instructions and Recipe Book," by Dazey.

(Continued)

*Primary Examiner*—Paul R Durand
(74) *Attorney, Agent, or Firm*—Hoffmann & Baron, LLP

(57) ABSTRACT

An apparatus for vacuum sealing a storage bag including a base and a receptacle component for receiving the end of a storage bag. A vacuum generating device is disposed in either one of the base or the receptacle. The receptacle includes a vacuum chamber for accepting the open end of the bag. The receptacle is pivotally secured to the base and is rotatable relative thereto between a first and second position. A sealing device is disposed on the receptacle for sealing the open end of the bag.

34 Claims, 23 Drawing Sheets

U.S. PATENT DOCUMENTS

| | | | | |
|---|---|---|---|---|
| 2,672,268 | A | | 3/1954 | Bower |
| 2,749,686 | A | | 6/1956 | Lorenz et al. |
| 2,755,952 | A | | 7/1956 | Ringen |
| 2,778,171 | A | | 1/1957 | Taunton |
| 2,778,177 | A | * | 1/1957 | Mahaffy et al. ..... 53/86 |
| 2,838,894 | A | | 6/1958 | Paikens et al. |
| 2,899,786 | A | | 8/1959 | Harker |
| 2,963,838 | A | | 12/1960 | Harrison et al. |
| 2,991,609 | A | * | 7/1961 | Randall ..... 53/374.9 |
| 3,038,283 | A | | 6/1962 | Unger |
| 3,055,536 | A | | 9/1962 | Dieny |
| 3,064,358 | A | | 11/1962 | Gluffre |
| 3,148,269 | A | | 9/1964 | Van Hartesveldt et al. |
| 3,234,072 | A | | 2/1966 | Dreeben |
| 3,320,097 | A | | 5/1967 | Sugalski |
| 3,464,256 | A | | 9/1969 | Lloyd |
| 3,516,223 | A | | 6/1970 | Andersen et al. |
| 3,532,323 | A | | 10/1970 | Uhen |
| 3,552,816 | A | | 1/1971 | Wolanin |
| 3,589,098 | A | | 6/1971 | Schainholz et al. |
| 3,688,463 | A | | 9/1972 | Titchenal |
| 3,699,742 | A | | 10/1972 | Giraudi |
| 3,788,651 | A | | 1/1974 | Brown et al. |
| 3,800,503 | A | | 4/1974 | Makl |
| 3,832,824 | A | | 9/1974 | Burrell |
| 3,851,437 | A | * | 12/1974 | Waldrop et al. ..... 53/434 |
| 3,858,750 | A | | 1/1975 | Grall |
| 3,866,390 | A | | 2/1975 | Moreland, II et al. |
| 3,928,938 | A | | 12/1975 | Burrell |
| 3,962,847 | A | | 6/1976 | Trudel |
| 3,965,646 | A | | 6/1976 | Hawkins |
| 4,006,329 | A | | 2/1977 | Hellman et al. |
| 4,008,601 | A | | 2/1977 | Woods |
| 4,021,290 | A | | 5/1977 | Smith |
| 4,059,113 | A | | 11/1977 | Beinsen et al. |
| 4,105,491 | A | | 8/1978 | Haase et al. |
| 4,106,661 | A | | 8/1978 | Hunt |
| 4,143,787 | A | | 3/1979 | Walker |
| RE30,045 | E | | 7/1979 | Greene |
| 4,164,111 | A | | 8/1979 | Di Bernardo |
| 4,179,862 | A | | 12/1979 | Landolt |
| 4,208,902 | A | | 6/1980 | Kim et al. |
| 4,221,101 | A | | 9/1980 | Woods |
| 4,222,276 | A | | 9/1980 | DeRogatis |
| 4,330,975 | A | * | 5/1982 | Kakiuchi ..... 53/79 |
| 4,371,175 | A | | 2/1983 | Van Dyk, Jr. |
| 4,372,096 | A | | 2/1983 | Baum |
| 4,471,599 | A | | 9/1984 | Mugnai |
| 4,541,224 | A | | 9/1985 | Mugnai |
| 4,545,177 | A | | 10/1985 | Day |
| 4,549,387 | A | | 10/1985 | Marshall et al. |
| 4,561,925 | A | | 12/1985 | Skerjanec et al. |
| 4,578,928 | A | | 4/1986 | Andre et al. |
| 4,581,764 | A | | 4/1986 | Plock et al. |
| 4,583,347 | A | | 4/1986 | Nielsen |
| 4,620,408 | A | | 11/1986 | Parnes |
| 4,631,512 | A | | 12/1986 | Hishiki et al. |
| 4,641,482 | A | | 2/1987 | Metz |
| 4,756,140 | A | | 7/1988 | Gannon |
| 4,848,244 | A | * | 7/1989 | Bennett ..... 108/38 |
| 4,860,523 | A | | 8/1989 | Teteishi et al. |
| 4,909,014 | A | | 3/1990 | Kobayashi et al. |
| 4,922,686 | A | | 5/1990 | Segota |
| 4,928,829 | A | | 5/1990 | Di Bernardo |
| 4,941,310 | A | | 7/1990 | Kristen |
| 5,012,615 | A | | 5/1991 | Piccinini et al. |
| 5,048,269 | A | | 9/1991 | Deni |
| 5,056,292 | A | | 10/1991 | Natterer |
| 5,177,937 | A | | 1/1993 | Alden |
| 5,209,044 | A | | 5/1993 | D'Addario et al. |
| 5,232,016 | A | | 8/1993 | Chun |
| 5,239,808 | A | | 8/1993 | Wells et al. |
| 5,352,323 | A | | 10/1994 | Chi |
| RE34,929 | E | | 5/1995 | Kristen |
| 5,450,963 | A | | 9/1995 | Carson |
| 5,461,901 | A | | 10/1995 | Ottestad |
| 5,465,857 | A | | 11/1995 | Yang |
| 5,515,773 | A | | 5/1996 | Bullard |
| 5,544,752 | A | | 8/1996 | Cox |
| 5,551,213 | A | | 9/1996 | Koelsch et al. |
| 5,608,167 | A | | 3/1997 | Hale et al. |
| 5,617,893 | A | | 4/1997 | Webster |
| 5,620,098 | A | | 4/1997 | Boos et al. |
| 5,638,664 | A | | 6/1997 | Levsen et al. |
| 5,655,357 | A | | 8/1997 | Kristen |
| 5,682,727 | A | | 11/1997 | Harte et al. |
| D389,847 | S | | 1/1998 | Huang |
| 5,712,553 | A | | 1/1998 | Hallberg |
| 5,735,395 | A | | 4/1998 | Lo |
| 5,765,608 | A | | 6/1998 | Kristen |
| 5,784,857 | A | | 7/1998 | Ford et al. |
| 5,784,862 | A | * | 7/1998 | Germano ..... 53/512 |
| 5,803,282 | A | | 9/1998 | Chen et al. |
| 5,825,974 | A | | 10/1998 | Hutton |
| 5,889,664 | A | | 3/1999 | Ben-David et al. |
| 5,893,822 | A | * | 4/1999 | Deni et al. ..... 53/512 |
| 5,954,196 | A | | 9/1999 | Lin |
| 6,058,998 | A | | 5/2000 | Kristen |
| 6,070,397 | A | | 6/2000 | Bachhuber |
| 6,072,172 | A | | 6/2000 | Duggan et al. |
| 6,085,906 | A | | 7/2000 | Lambert |
| 6,124,558 | A | | 9/2000 | Baumeister et al. |
| 6,161,716 | A | | 12/2000 | Oberhofer et al. |
| 6,256,968 | B1 | | 7/2001 | Kristen |
| 6,328,897 | B1 | | 12/2001 | Leung |
| 6,441,323 | B1 | | 8/2002 | Montagnino et al. |
| 6,467,242 | B1 | | 10/2002 | Huang |
| 6,481,180 | B1 | | 11/2002 | Takahashi et al. |
| 6,520,071 | B1 | | 2/2003 | Lanza |
| 6,619,493 | B2 | | 9/2003 | Yang |
| 6,694,710 | B2 | | 2/2004 | Wang |
| 6,789,690 | B2 | | 9/2004 | Nieh et al. |
| 6,792,736 | B1 | | 9/2004 | Takahashi et al. |
| 6,827,243 | B1 | | 12/2004 | Nuzzolese |
| 7,003,928 | B2 | * | 2/2006 | Patterson et al. ..... 53/405 |
| 7,021,027 | B2 | | 4/2006 | Higer et al. |
| 7,076,929 | B2 | | 7/2006 | Patterson et al. |
| 7,131,250 | B2 | | 11/2006 | Kahn et al. |
| 7,200,974 | B2 | | 4/2007 | Higer et al. |
| 7,204,067 | B2 | | 4/2007 | Baptista |
| 2003/0000180 | A1 | | 1/2003 | Singer |
| 2003/0103881 | A1 | | 6/2003 | Lane et al. |
| 2003/0140603 | A1 | | 7/2003 | Karsenics et al. |
| 2003/0159405 | A1 | | 8/2003 | Knowlton et al. |
| 2004/0031245 | A1 | | 2/2004 | Kingeter et al. |
| 2004/0060262 | A1 | | 4/2004 | Harges et al. |
| 2004/0099332 | A1 | | 5/2004 | Kieck |
| 2004/0134359 | A1 | | 7/2004 | Schiro et al. |
| 2005/0011166 | A1 | | 1/2005 | Germano |
| 2005/0022473 | A1 | | 2/2005 | Small et al. |
| 2005/0022474 | A1 | | 2/2005 | Albritton et al. |
| 2005/0028494 | A1 | | 2/2005 | Higer et al. |
| 2005/0039420 | A1 | | 2/2005 | Albritton et al. |
| 2005/0050856 | A1 | | 3/2005 | Baptista |
| 2005/0108990 | A1 | | 5/2005 | Kahn et al. |
| 2006/0123737 | A1 | | 6/2006 | Higer et al. |
| 2006/0218885 | A1 | | 10/2006 | Higer et al. |
| 2007/0033907 | A1 | | 2/2007 | Higer et al. |
| 2007/0068120 | A1 | | 3/2007 | Kahn et al. |
| 2007/0193230 | A1 | | 8/2007 | Baptista |

2007/0204561 A1 9/2007 Kahn et al.

FOREIGN PATENT DOCUMENTS

| | | | |
|---|---|---|---|
| EP | 0 723 915 | B1 | 9/1999 |
| EP | 1053945 | A1 | 11/2000 |
| EP | 1 149 768 | A1 | 10/2001 |
| EP | 1 433 719 | A1 | 6/2004 |
| GB | 2211161 | A | 6/1989 |
| IT | 1 278 835 | | 11/1997 |
| JP | A-S62-287823 | | 12/1987 |
| JP | U-S63-079307 | | 5/1988 |
| JP | 63-307023 | | 12/1988 |
| JP | 05-10211 | | 2/1993 |
| JP | 2000-043818 | | 2/2000 |
| JP | A-2002-308215 | | 10/2002 |
| WO | WO 99/48758 | | 9/1999 |
| WO | WO 00/71422 | | 11/2000 |
| WO | WO 02/10017 | A1 | 2/2002 |
| WO | WO 03/064261 | A1 | 8/2003 |
| WO | WO 2004/048203 | | 6/2004 |
| WO | WO 2004/065222 | A1 | 8/2004 |

OTHER PUBLICATIONS

"Foodsaver, The First Commercial-Quality Vacuum Packaging System for the Home," Deanna DeLong, 1988.
"Foodsaver, The First Commercial-Quality Vacuum Packaging System for the Home," Deanna DeLong, 1987.
Magic Vac® Champion Commercial Quality Vacuum Sealer Model #1750 © 2000, Instruction Manuel, Deni, pp. 1-15.
U.S. Appl. No. 11/446,937, filed Jun. 5, 2006.

* cited by examiner

VACUUM PACKAGING APPLIANCE

CROSS-REFERENCE TO RELATED APPLICATIONS

This application is a continuation-in-part of U.S. patent application Ser. No. 10/909,971, filed on Jul. 30, 2004, now U.S. Pat. No. 7,200,974 which claims priority to U.S. Provisional Application Nos. 60/492,035, filed on Jul. 31, 2003, and 60/492,090 filed Jul. 31, 2003, all three aforementioned applications are herein incorporated by reference in their entireties.

FIELD OF THE INVENTION

The present invention generally relates to vacuum packaging appliances. More particularly, the invention is directed to a vacuum packaging appliance that can be conveniently stored.

BACKGROUND OF THE INVENTION

Vacuum packaging is a process for removing oxygen and other gases from containers holding food and other products that deteriorate in the presence of gases. For example, food spoilage can occur due to oxidation. Thus, vacuum packaging can extend the life of products that deteriorate in the presence of gases by removing nearly all of the gases in a sealed container in which such products are stored.

While vacuum packaging appliances are very useful, as with most appliances, appliance components suffer from wear and tear. For example, those movable components that are frequently handled are prone to fall into disrepair. Further, such appliances can be unwieldy and occupy a good deal of valuable counter space and/or storage space.

In addition, vacuum sealing appliances typically include a lid that is closed on the open end of a bag to isolate the bag end from ambient air. Such isolation is typically achieved by the use of resilient gaskets on the lid and the housing portion covered by the lid. Deforming the gaskets can take some effort for a user, who must force the lid downwardly until it is properly latched.

Accordingly, there is a need for vacuum packaging appliances that are configured for reduced wear and tear and for convenient storage. There is further a need for vacuum packaging appliances having a mechanism for easily securing the lid and providing adequate sealing.

SUMMARY OF THE INVENTION

It is an advantage of the present invention to provide a vacuum sealing appliance which is easy to store.

It is also an advantage of the present invention to provide a vacuum sealing appliance that can be rotated between an operating position and a storage position.

It is further an advantage of the present invention to provide a vacuum sealing appliance having a lid that can be selectively secured in a closed position.

It is still a further advantage of the present invention to provide a vacuum sealing appliance having a lid that can be selectively secured in a closed position by a latching mechanism including an actuator that is moveable by a user.

In the efficient attainment of these and other advantages, the present invention provides an apparatus for vacuum sealing a storage bag including a base and a receptacle component for receiving the end of a storage bag. A vacuum generating device is disposed in either the base or the receptacle. The receptacle includes a vacuum chamber for accepting the open end of the bag. The receptacle is pivotally secured to the base and is rotatable relative thereto between a first and second position. A sealing device is disposed on the receptacle for sealing the open end of the bag.

The present invention may further provide a receptacle having a lid movable between an open and closed position, and a latch for selectively securing the lid in the closed position.

The present invention may further provide a locking feature for selectively locking the receptacle relative to the base.

BRIEF DESCRIPTION OF THE DRAWINGS

The present invention is illustrated by way of example, and not by way of limitation.

DETAILED DESCRIPTION OF THE PREFERRED EMBODIMENTS

The present invention includes a vacuum sealing appliance having improved service life. The present invention also provides a vacuum sealing appliance which can be easily stored by pivoting between a first operating position and a second storage position.

According to certain embodiments the vacuum appliance is designed to be lidless in order to reduce the number of movable parts and thus effectively reduce wear and tear of the appliance. Further, the lidless design described herein allows for convenient placement in the operational environment of the appliance. For example, a lidless vacuum appliance can be affixed under a counter or cabinet so as to save counter-top space as well as allow for convenient access during operational mode. When such an appliance is not is use, there is no need to find storage space for the appliance since the appliance is affixed in a location that is largely non-intrusive.

Figure 1:
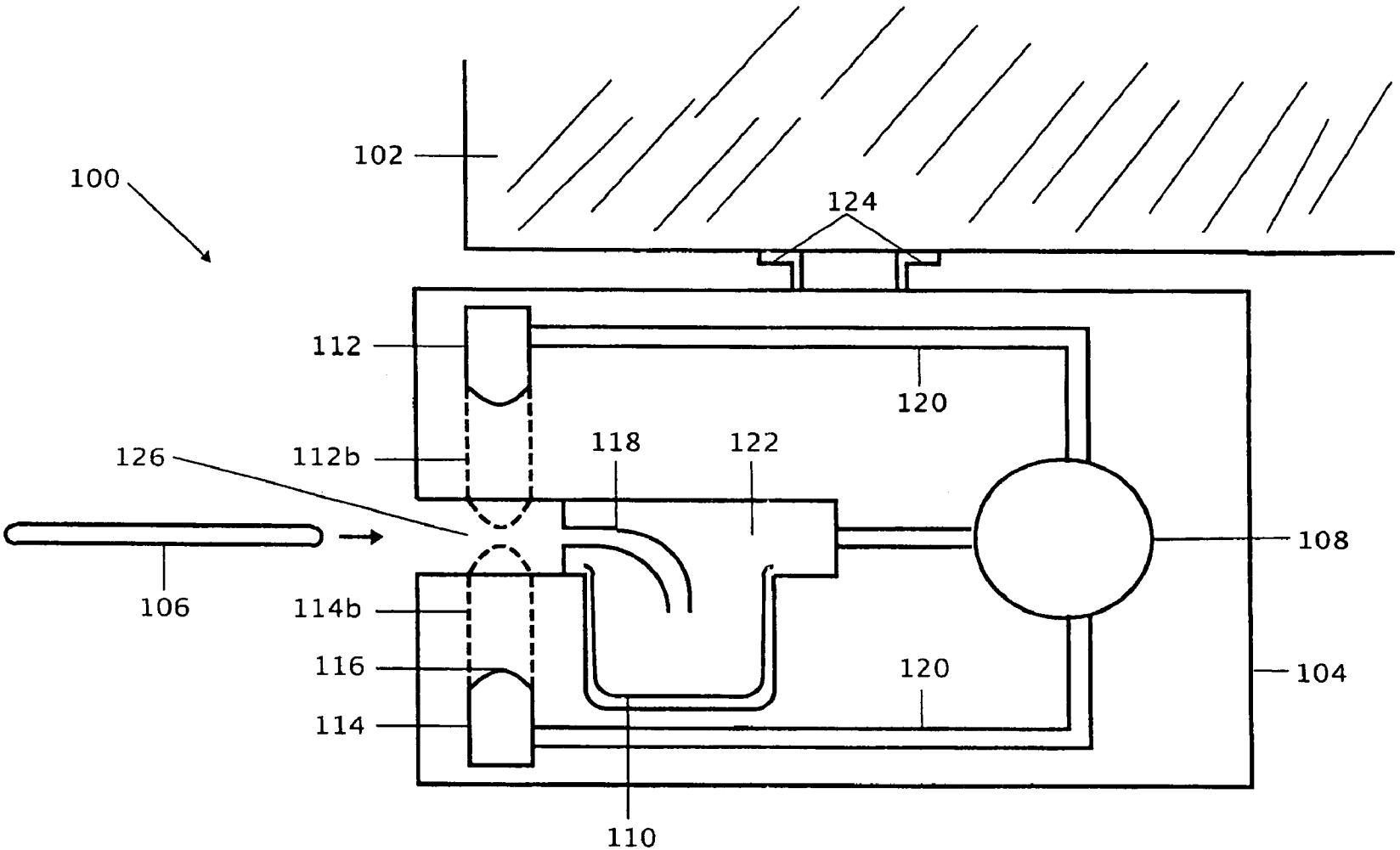
FIG. 1 is a cross-sectional view of a lidless vacuum appliance, according to certain embodiments of the present invention.

FIG. 1 is a cross-sectional view of a lidless vacuum appliance, according to certain embodiments. View 100 shows a side view of cabinet or counter 102 and lidless vacuum appliance 104 and packaging bag 106. Lidless vacuum appliance 104 is affixed under the counter 102 by brackets 124. Lidless vacuum appliance 104 can be adapted for affixing to any supporting structure and thus may vary from implementation to implementation. For example, lidless vacuum appliance 104 can be affixed to a wall, an over-hang, or a boom that is either movable or fixed. FIG. 1 shows the lidless vacuum appliance 104 including a slot 126, a guide track 118, a drip tray 110, a vacuum chamber 122, a sealing element 116, bladders 112 and 114, and motor components 108. Bladders 112 and 114 are operationally connected to motor components 108 by connectivity components 120. Examples of connectivity components 120 are pipes or hoses. The lidless vacuum appliance also includes the attendant circuitry and other components (not shown) for operating the vacuum and sealing processes.

In order to vacuum seal packaging bag 106, packaging bag 106 is inserted in slot 126 of lidless vacuum appliance. Guide track 118 guides the mouth of packaging bag 106 into drip tray 110. Drip tray 110 is for catching any fluids or other particles that might fall out of the bag during the vacuum packaging process. Before the vacuum packaging process begins, bladders 112 and 114 each inflate in order to clamp onto packaging bag 106 to form an air-tight seal such that air does not flow through slot 126 past the bladders into the vacuum chamber. Bladders 112 and 114 are inflated by an intake of air through connectivity components 120 caused by operation of motor components 108. Phantom bladders 112*b* and 114*b* show the inflated position of bladders 112 and 114. When an airtight seal is formed, the vacuum packaging process can begin by evacuating gases from the vacuum chamber 122 and from the interior of packaging bag 106. When packaging bag 106 is sufficiently evacuated of gases, heating element 116 can be activated for forming a heat seal on packaging bag 106. Such a heat seal prevents air from re-entering the bag. After packaging bag 106 is heat sealed, bladders 112 and 114 can be deflated to allow packaging bag 106 to be extricated from the lidless vacuuming appliance 104.

Figure 2:
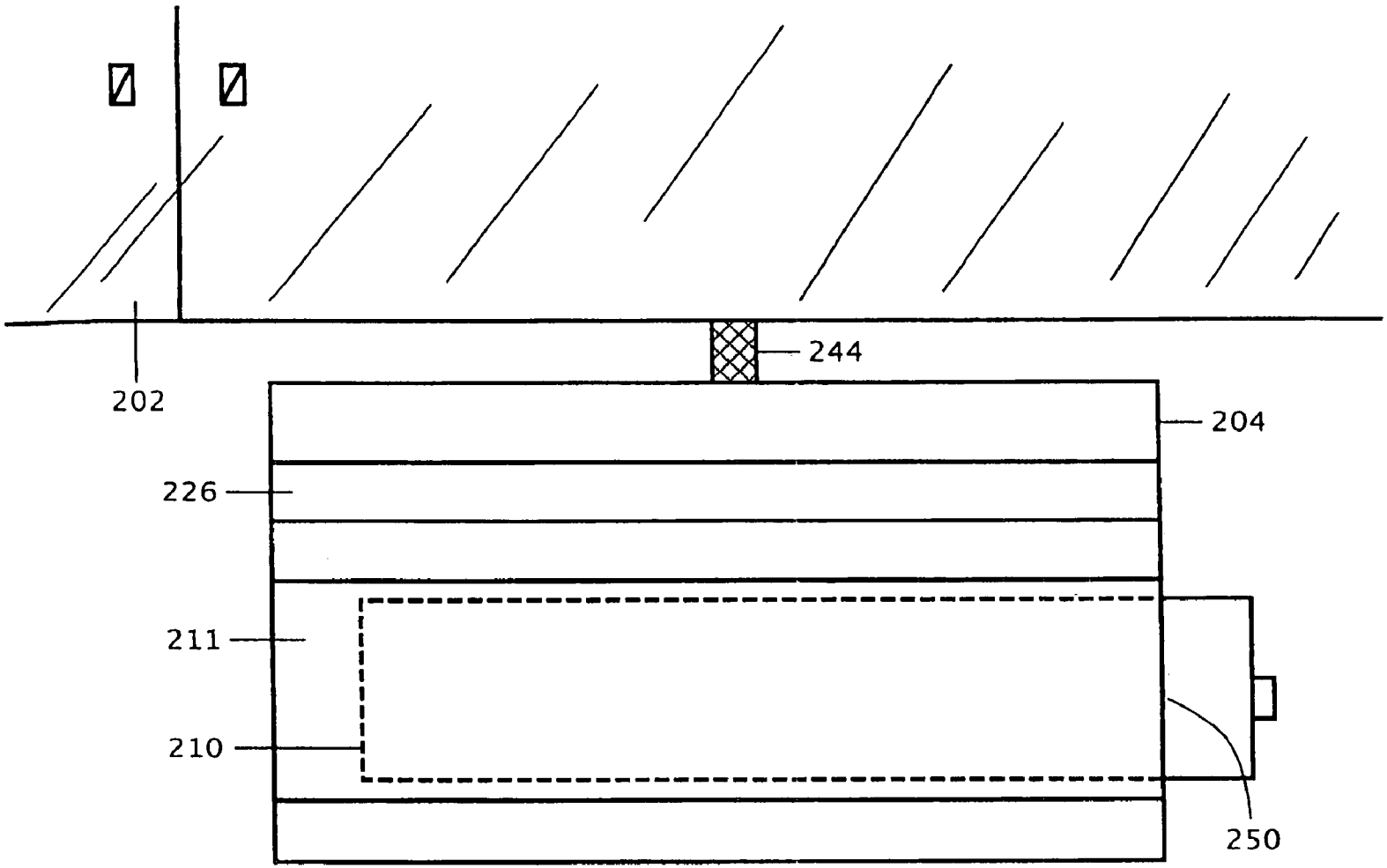
FIG. 2 is a frontal view of a lidless vacuum appliance, according to certain other embodiments of the present invention.

According to certain embodiments, drip tray 110 can be detached from the lidless vacuuming appliance 104 conveniently through an opening on the side of the appliance as described herein with reference to FIG. 2. FIG. 2 is a frontal view of a lidless vacuum appliance, according to certain other embodiments. In FIG. 2, a lidless vacuuming appliance 204 is affixed under a cabinet or counter 202 by one or more screws 244. FIG. 2 shows slot 226 through which a packaging bag can be inserted for evacuating gases from the packaging bag. FIG. 2 also shows a cavity 211 where drip tray 210 resides in lidless vacuum appliance 204. Drip tray 210 can be extricated from the appliance by sliding drip tray 210 out from lidless vacuum appliance 204 through opening 250. Opening 250 is sealed airtight when drip tray 210 is completely inserted into cavity 211.

Figure 3:
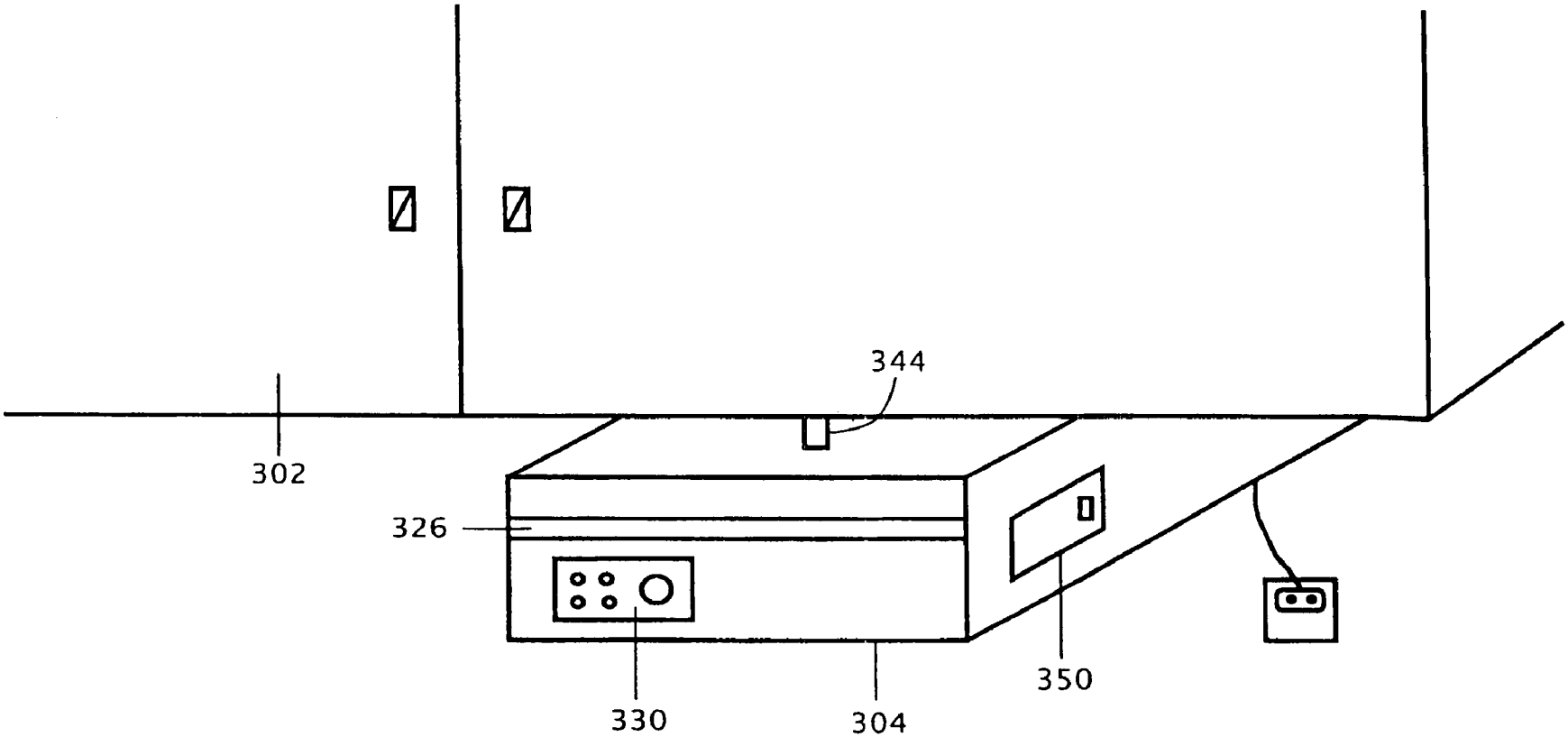
FIG. 3 is a partial perspective view of a lidless vacuum appliance that illustrates space-saving placement of the appliance.

FIG. 3 is a partial perspective view of a lidless vacuum appliance 304 that illustrates space-saving placement of the appliance. FIG. 3 shows that lidless vacuum appliance 304 is affixed under a cabinet or counter 302 by attachment 344. FIG. 3 also shows that lidless vacuum appliance 304 includes a slot 326, a control panel 330, and a side opening 350 (egress) through which the drip tray in the appliance can be extricated. According to certain embodiments, the lidless vacuum appliance 304 can include a pair of openings, one on either side of the appliance 304, either one of which can be used for extricating the drip tray.

Figure 4:
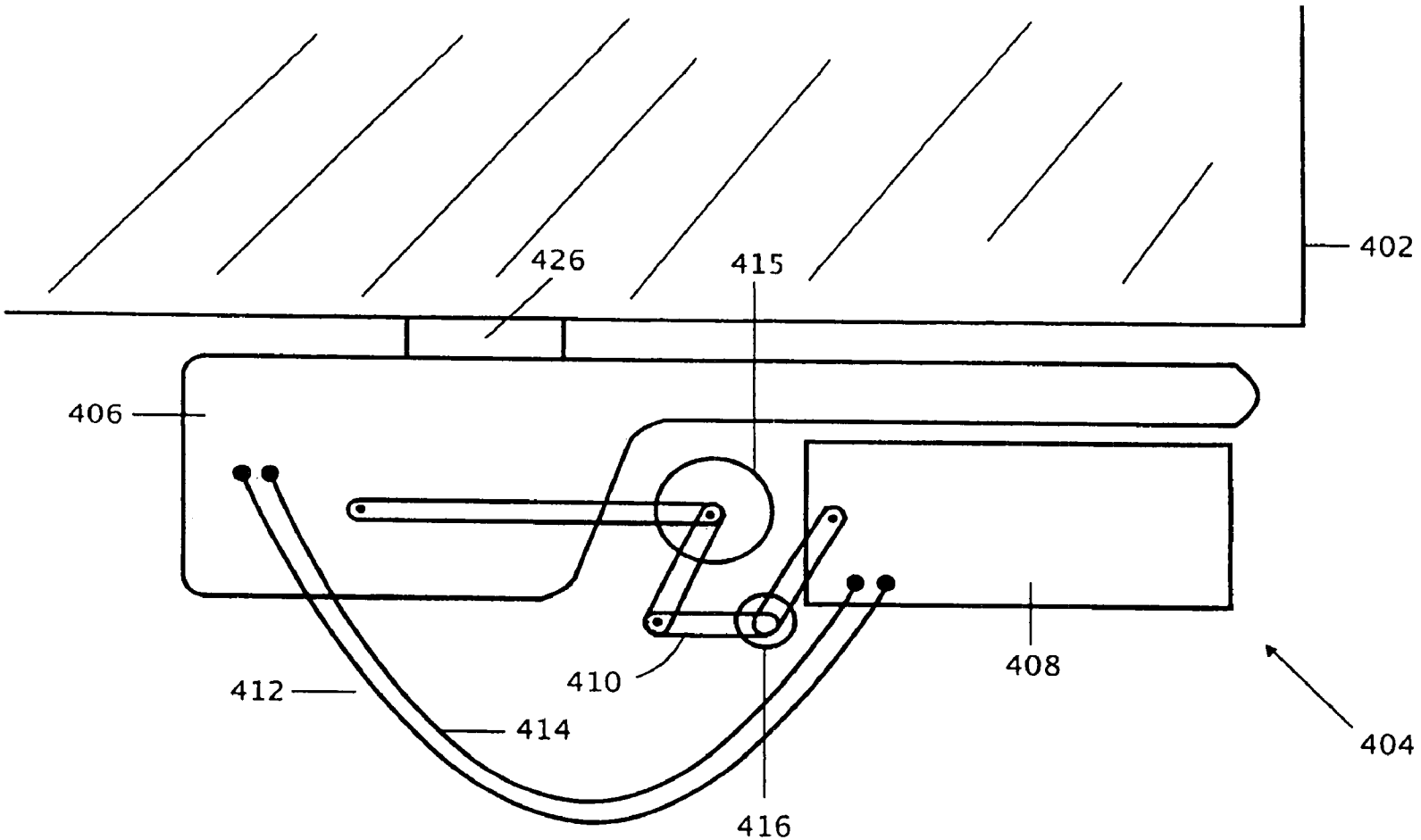
FIG. 4 is a side view of an under-cabinet or under-counter vacuum appliance in retracted storage mode.

FIG. 4 is a side view of an under-cabinet or under-counter vacuum appliance in retracted storage mode or position. In FIG. 4, lidless vacuum appliance 404 is affixed under cabinet 402 by an attachment 426. In FIG. 4, lidless vacuum appliance 404 is shown in a retracted storage mode as described herein. Lidless vacuum appliance 404 includes a fixed component 406 and a movable component 408, extension rods 410, electrical connection 414 and vacuum hose 412. Lidless vacuum appliance 404 can optionally include bag-roll 415 and bag-cutter 416. Fixed component 406 houses a vacuum motor (not shown) connected to a vacuum chamber (not shown) in movable component 408 via vacuum hose 412. Movable component 408 also houses a drip tray used for sealing a packaging bag. Vacuum hose 412 can also be used to inflate bladders in movable component 408 for sealing the vacuum chamber during an evacuation process. In FIG. 4, extension rods 410 are folded into a retracted position such that movable component 408 remains tucked under counter 402 and is in close proximity to fixed component 406.

Figure 5:
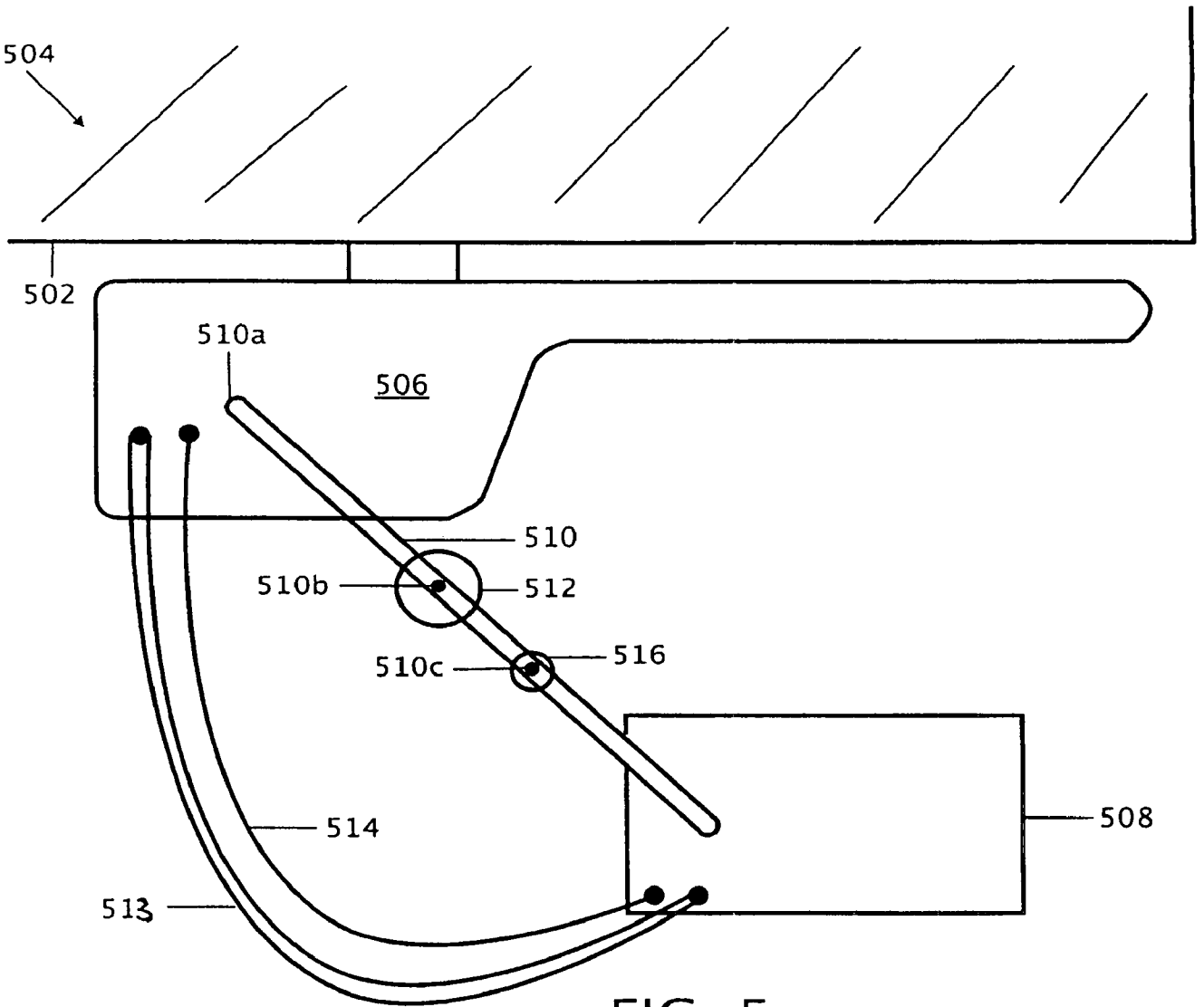
FIG. 5 is a side view of an under-cabinet or under-counter vacuum appliance in an extended configuration for operation.

FIG. 5 is a side view of an under-cabinet or under-counter vacuum appliance in an extended configuration for operation. In FIG. 5, movable component 508 of lidless vacuum appliance 504 is extended away from fixed component 506 of lidless vacuum appliance 504. Such an extension is made possible by unfolding extension rods 510. Extension rods 510 can also be pivoted about joints 510*a*, 510*b* and 510*c* in order to situate movable component 508 in a suitable position for operation. In the extended position, movable component 508 is conveniently located for ease of use. FIG. 5 also shows bag roll 515, bag cutter 516, electrical connection 514 and vacuum hose 513.

Figure 6B:
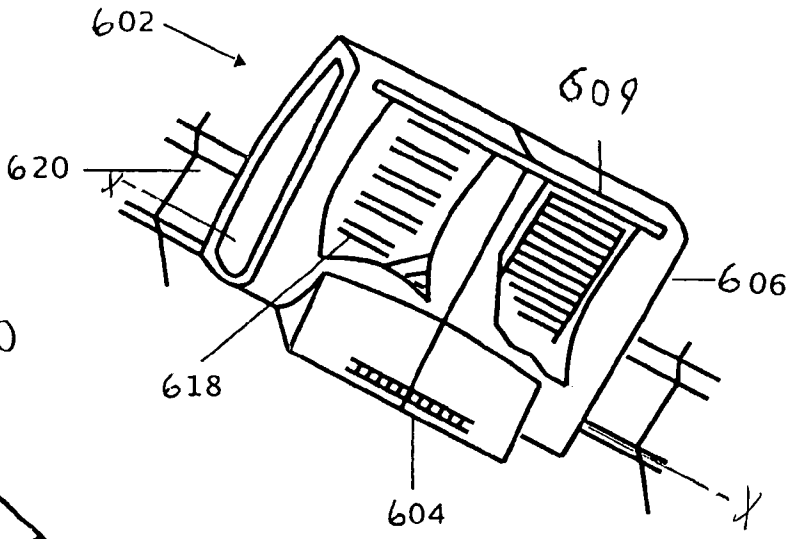
FIG. 6B is a perspective view of the vacuum appliance of FIG. 6A in storage position.
Figure 6A:
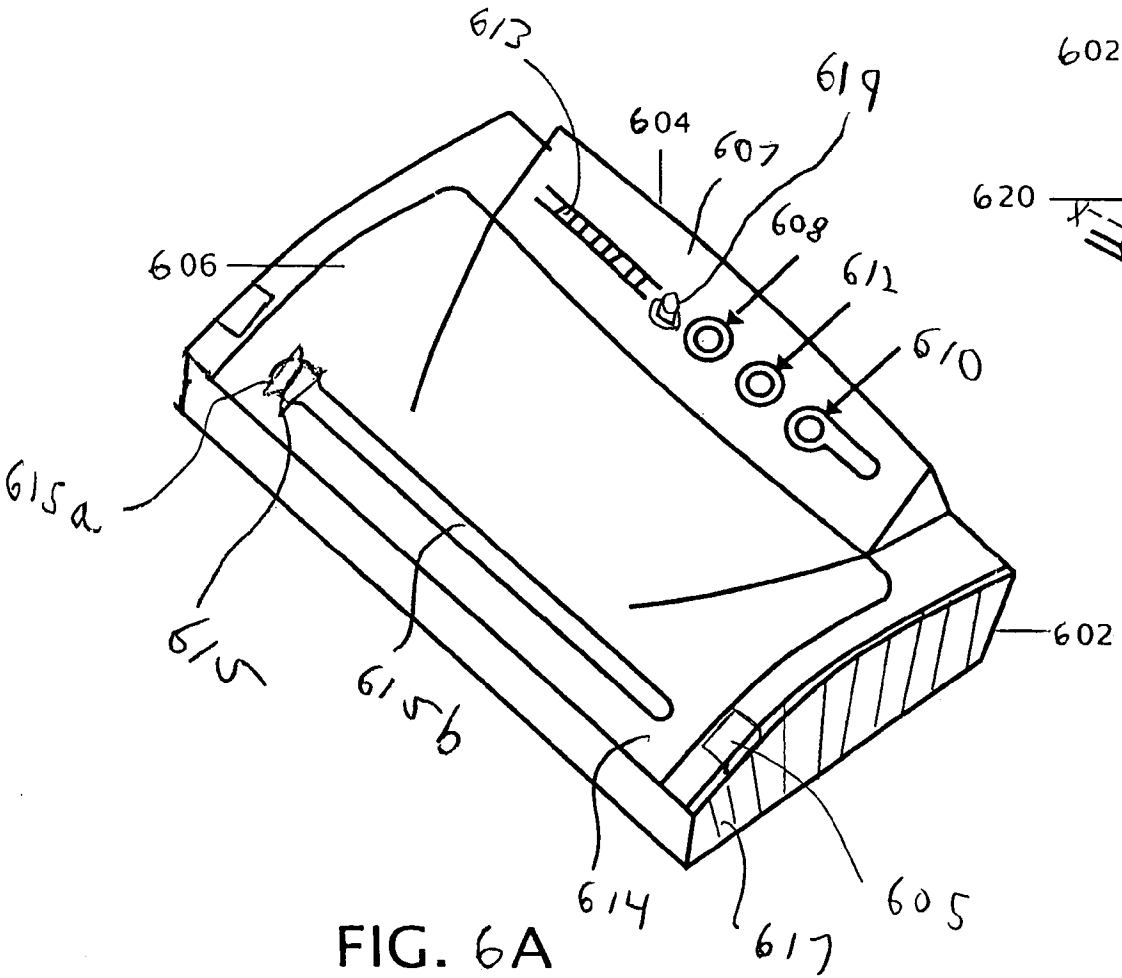
FIG. 6A is a perspective view of a further embodiment of a vacuum appliance in an operating position.

In an alternative embodiment, shown in FIGS. 6A-6B, the vacuum packaging apparatus provides space saving properties by rotating between a first operating position and a second stored position. Vacuum packaging apparatus 602 includes a base 604 and a receptacle 606 which is pivotable relative to the base. Pivotable receptacle 606 receives the packaging bag that is to be evacuated of gases when evacuation is desired. Stationary base 604 may include a vacuum pump (not shown), sealing mechanism (not shown) and controls (not shown) associated with the operation of the vacuum pump and sealing mechanism. Stationary base 604 may include a control panel 607 at the top frontal portion of the stationary base. Control panel 607 may include an accessory port 608 for use in removing gases from storage canisters. Control panel 607 may also include an instant seal button 610 to manually start sealing a storage bag, and a vacuum button 612 to start removing gases from storage bags or canisters.

The sealing function may be automatically activated when the lid of the movable receptacle component 606 is in the closed position over one end of a storage bag, which end is not in a vacuum channel of the vacuum packaging apparatus. When a storage bag is being evacuated through activation of the vacuuming function, the instant seal button 610 may be used to seal a storage bag before a complete vacuum is created in the storage bag. This feature is useful when vacuum packaging fragile items so that such items do not get crushed. In addition, control panel 607 may include indicator lights 613 to signal the start or completion of various processes such as the sealing process, vacuum process and/or machine re-programming when transitioning from one process to the next. Control panel 607 may optionally include an automatic On/Off button. The automatic On/Off button acts as a fail-safe mechanism to ensure that the heat sealing and or vacuum mechanisms are not unintentionally activated. Further, control panel 607 may optionally include a Cancel Button for canceling a given operation in progress.

Control panel 607 may also include sealing time adjustment knob 619 for controlling the heating element associated with the sealing mechanism. For example, the sealing time adjustment can be set to a first setting when storage bags are being sealed. The sealing time adjustment can be set to a second setting when canisters are being sealed. In the case of sealing canisters, there is no need for activating the heating element.

In certain embodiments, the vacuum operation for removing gases automatically starts when the lid of movable receptacle component is in the closed position. In such cases, control panel 607 may include an extended vacuum button. The extended vacuum button may be used to extend the vacuum time to ensure that the maximum amount of air is removed especially when using extra large storage canisters or bags.

The movable receptacle component 606 may include a compartment 617 with a lid 614. Compartment 617 includes a vacuum chamber. The vacuum chamber includes a vacuum channel that is in communication with the vacuum pump. Further, the vacuum chamber includes one or more gaskets for statically sealing the vacuum chamber when the lid 614 is in the closed position. Compartment 617 may include a storage bag cutter 615 integrated into lid 614. Bag cutter 615 may include a sliding blade 615*a* which travels in a slotted track 615*b* disposed on the lid 614 in a manner well know in the art. The compartment 617 may also contain a shelf mechanism for holding one or more rolls of storage bags. Furthermore, movable receptacle component 606 may include a latch 605 that automatically locks during the sealing and/or vacuuming operation. Latch 605 is released in order to pop lid 614 open.

FIG. 6B is an isometric view that illustrates the pivoting vacuum packaging apparatus of FIG. 6A in a pivoted configuration for convenient storage. In FIG. 6B, stationary base 604 of the vacuum packaging apparatus 602 may optionally be affixed to a wall or countertop back-splash 620. Movable receptacle component 604 may be pivoted up ("flipped-up") towards the wall, about a pivot axis, X-X, that runs the length of stationary base 604.

Movable receptacle component 606 may optionally include an x-ray style strip 609 for holding notes and recipes 618. X-ray style strip 609 doubles as a foot when movable receptacle component 606 lies flat on the countertop surface during operation mode. The pivoted configuration as shown in FIG. 6B saves countertop space. Optionally, vacuum packaging apparatus 602 may include a mechanism that prevents operation of the vacuum packaging apparatus when the vacuum packaging apparatus is in the flipped-up position.

Figure 7B:
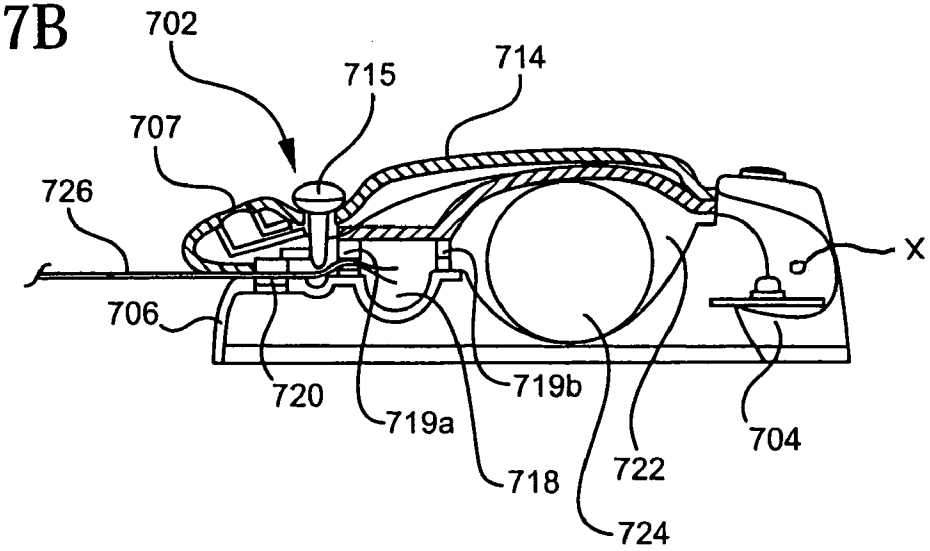
FIG. 7B is a cross-sectional view of the vacuum appliance of FIG. 7A taken along line B-B thereof.
Figure 7A:
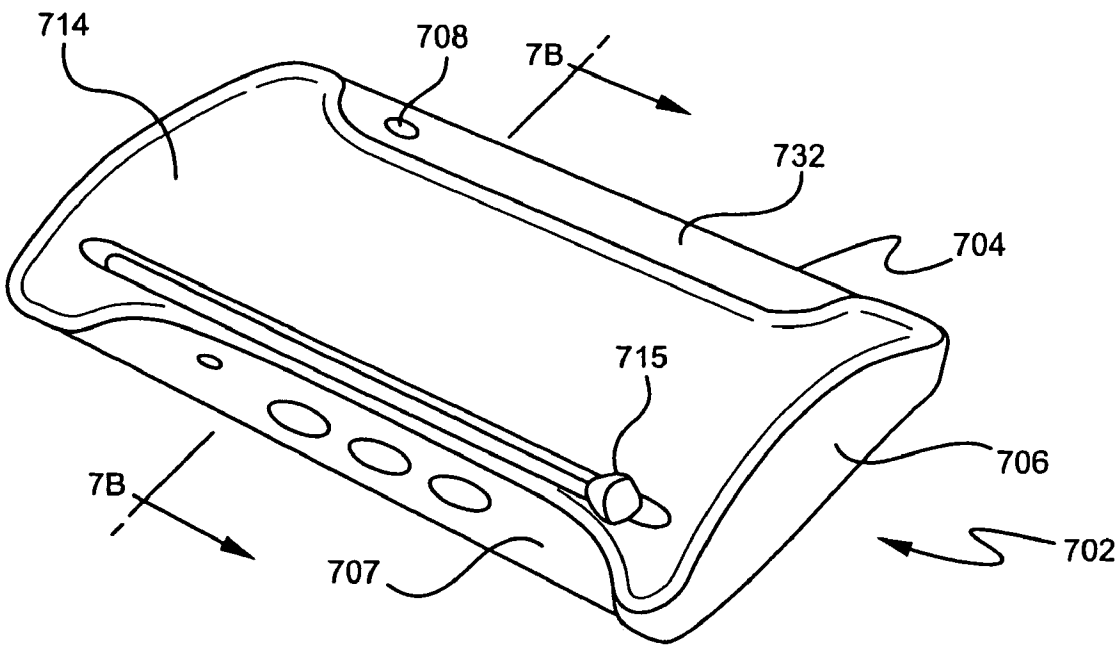
FIG. 7A is a perspective view of an alternative embodiment of a vacuum appliance.

FIGS. 7A-7B illustrate an alternative embodiment of a pivoting vacuum packaging apparatus 702 with a stationary base 704 and a pivotal receptacle 706 with control panel 707 on a lid 714. Vacuum packaging apparatus 702 is similar to vacuum packaging apparatus 602 of FIG. 6A. Thus, the description of stationary base 604, bag-cutting unit 615, and movable receptacle component 606 apply to stationary base 704, bag-cutting unit 715, and movable receptacle component 706, respectively. Similarly, movable receptacle component 706 is operable to be rotated about axis X such that it can be flipped-up over the stationary base 704 for convenient space saving storage.

Vacuum packaging apparatus 702 further includes a trough 718 running along the length of the receptacle 706. The front end of the bag 726 extends into the trough which is sealed by gaskets 719*a* and 719*b* surrounding the trough. The trough may be evacuated permitting air within the bag to be evacuated through the bag opening. After the bag is evacuated, the opening may be sealed by a heating strip 720 in a manner well known in the art. The receptacle 706 may also include a bag roll storage area 722 for holding a roll of bag material 724.

One of the differences between vacuum packaging apparatus 602 and vacuum packaging apparatus 702 is that the control panel 707 is on lid 714 rather than on a top frontal portion of stationary base 702. Further, accessory port 708 may be situated on an exposed lower housing 732.

Figure 8A:
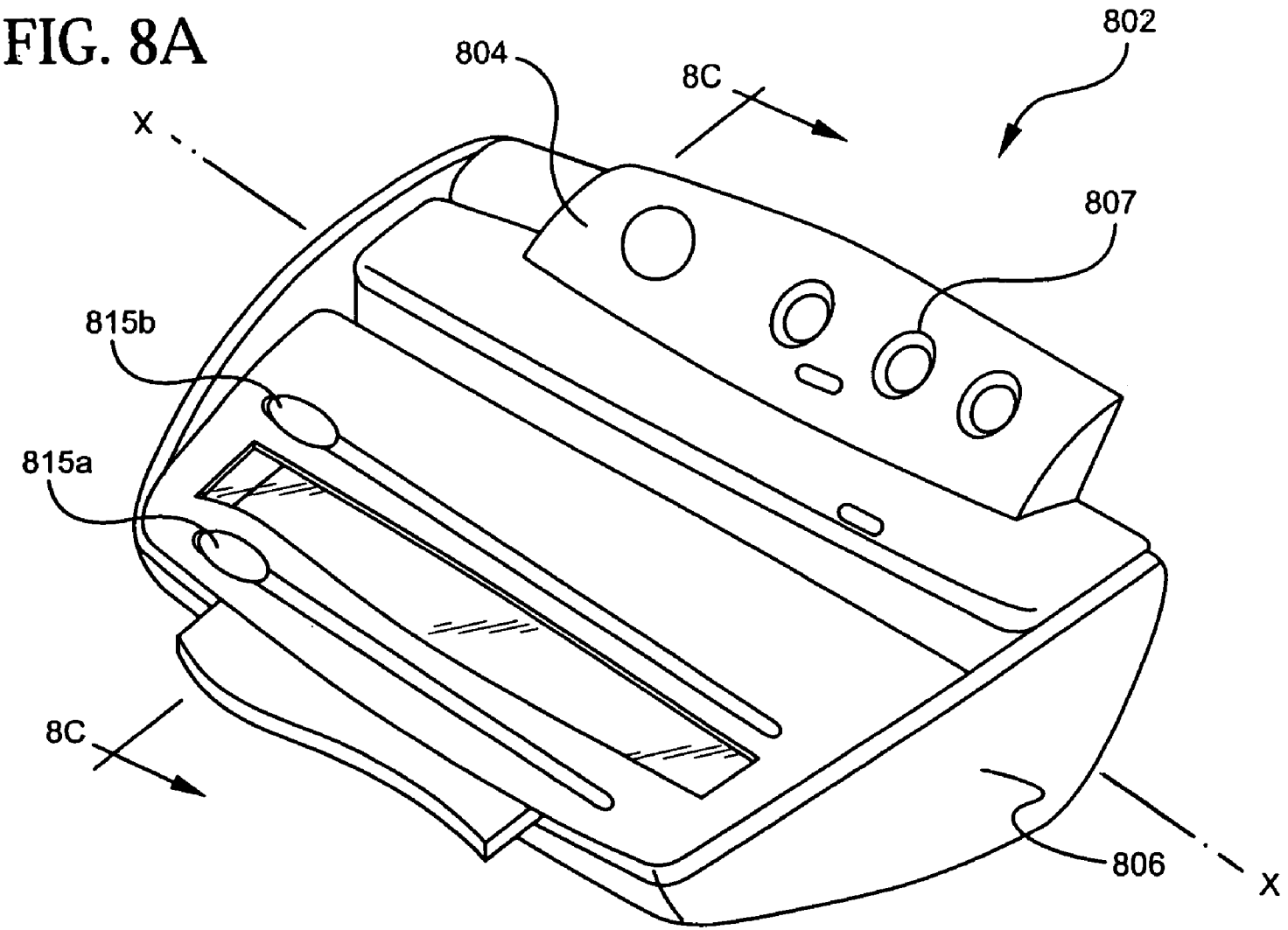
FIG. 8A is a perspective view of another alternative embodiment of a vacuum appliance.

FIG. 8A is an isometric view that illustrates certain embodiments of a pivoting vacuum packaging apparatus 802 with a dual bag roll shelf. Vacuum packaging apparatus 802 is similar to vacuum packaging apparatus 602 of FIG. 6A. Thus, the description of stationary base 604, control panel 607, and movable receptacle component 606 apply to stationary base 804, control panel 807, and movable receptacle component 806, respectively. Similarly, movable receptacle component 806 is operable to be flipped-up over the stationary base 804 (FIG. 8C) for convenient storage.

Figure 8C:
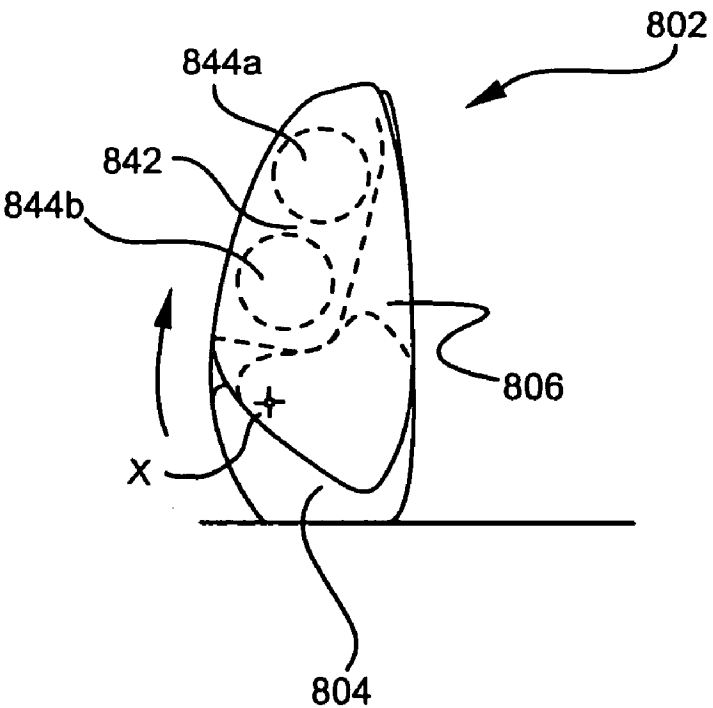
FIG. 8C is a side cross-sectional view of the vacuum appliance of FIG. 8A shown in the storage position taken along line C-C thereof.
Figure 8B:
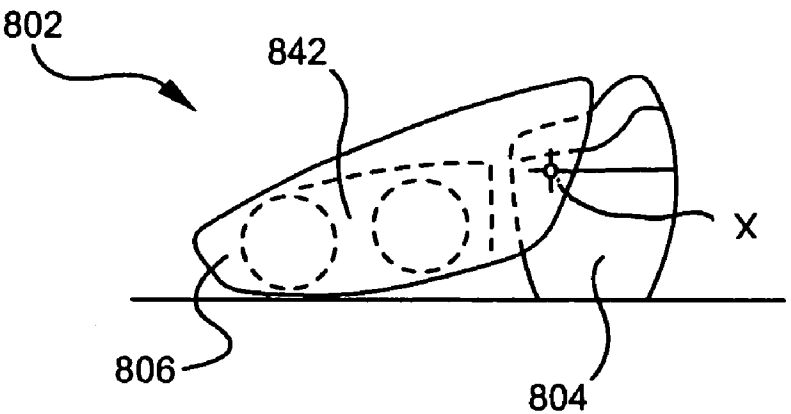
FIG. 8B is a side cross-sectional view of the vacuum appliance of FIG. 8A shown in the operating position taken along line C-C thereof.

One of the differences between vacuum packaging apparatus 602 and vacuum packaging apparatus 802 is that the movable receptacle component 806 is operable to house a dual bag roll shelf 842 as shown in FIGS. 8B and 8C. Dual roll shelf 842 can hold two rolls 844*a* and 844*b* of storage bags. Further, vacuum packaging apparatus 802 has two bag-cutting units 815*a* and 815*b* (FIG. 8A) since the apparatus can hold two rolls of storage bags. As shown in FIGS. 8B and 8C the receptacle may be rotated about an axis X between a flipped-up storage position (FIG. 8C) and a flipped-down operating position (FIG. 8B).

Figure 9B:
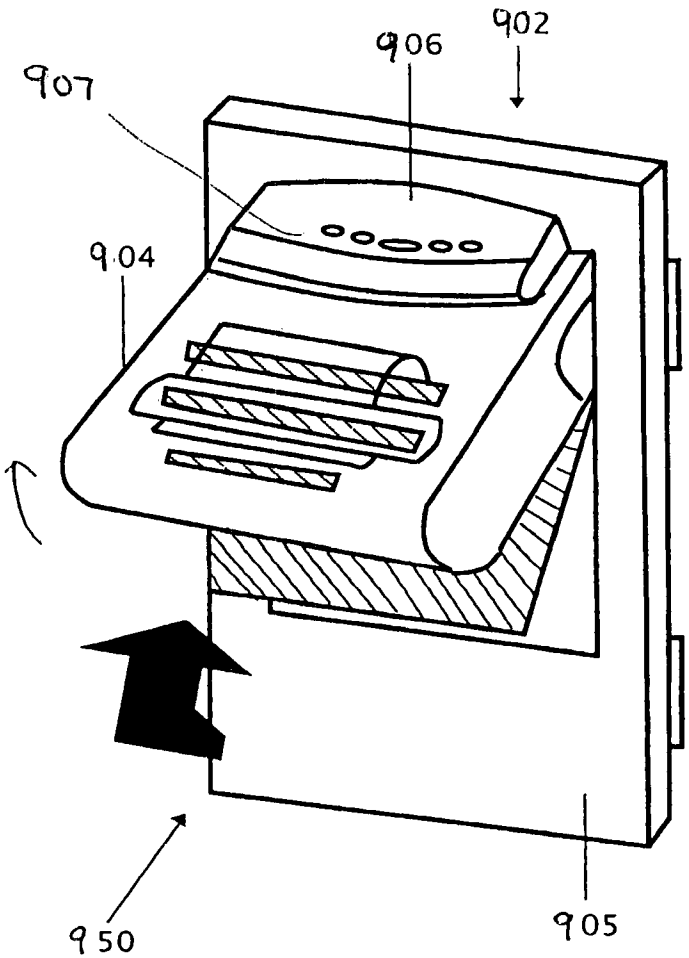
FIG. 9B is a perspective view of the vacuum appliance of FIG. 9A in an operating mode for a wall or cabinet.
Figure 9A:
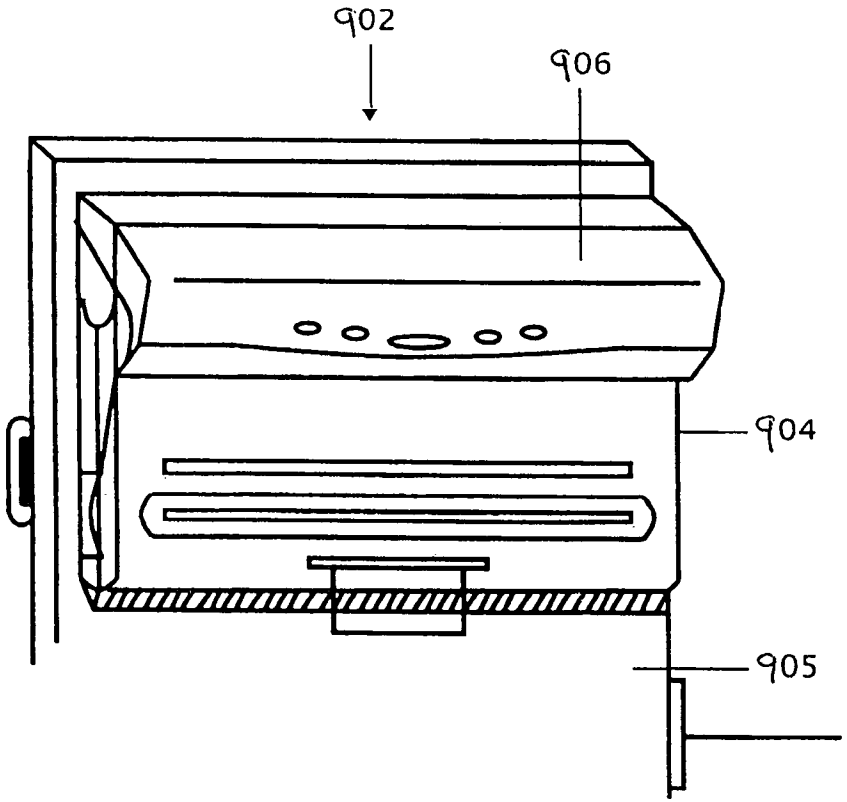
FIG. 9A is a perspective view of a further embodiment of a vacuum appliance in storage mode for a wall or cabinet.

FIGS. 9A and 9B illustrate a frontal isometric view of a vacuum appliance 902 for a wall or cabinet. FIGS. 9A and 9B show a vacuum appliance 902 affixed to a cabinet door or to a wall 905. Vacuum appliance 902 includes a movable receptacle component 904 and a fixed component 906. Fixed component 906 may include a control panel 907 including similar features as those described with respect to FIG. 6A. Receptacle component 904 may be pivoted up away from wall 905, i.e., flipped-up, about a pivot axis that runs the length of fixed component 906. Movable receptacle component 904 is flipped up when in operating mode as shown in FIG. 9B. FIG. 9A shows vacuum appliance 902 in a storage mode. In this configuration, movable receptacle component 904 may be pivoted down against wall 905. In other words, vacuum appliance 902 is flipped-down for convenient storage (idle storage mode). Vacuum appliance 902 can be a lidless vacuum appliance.

Figure 11A:
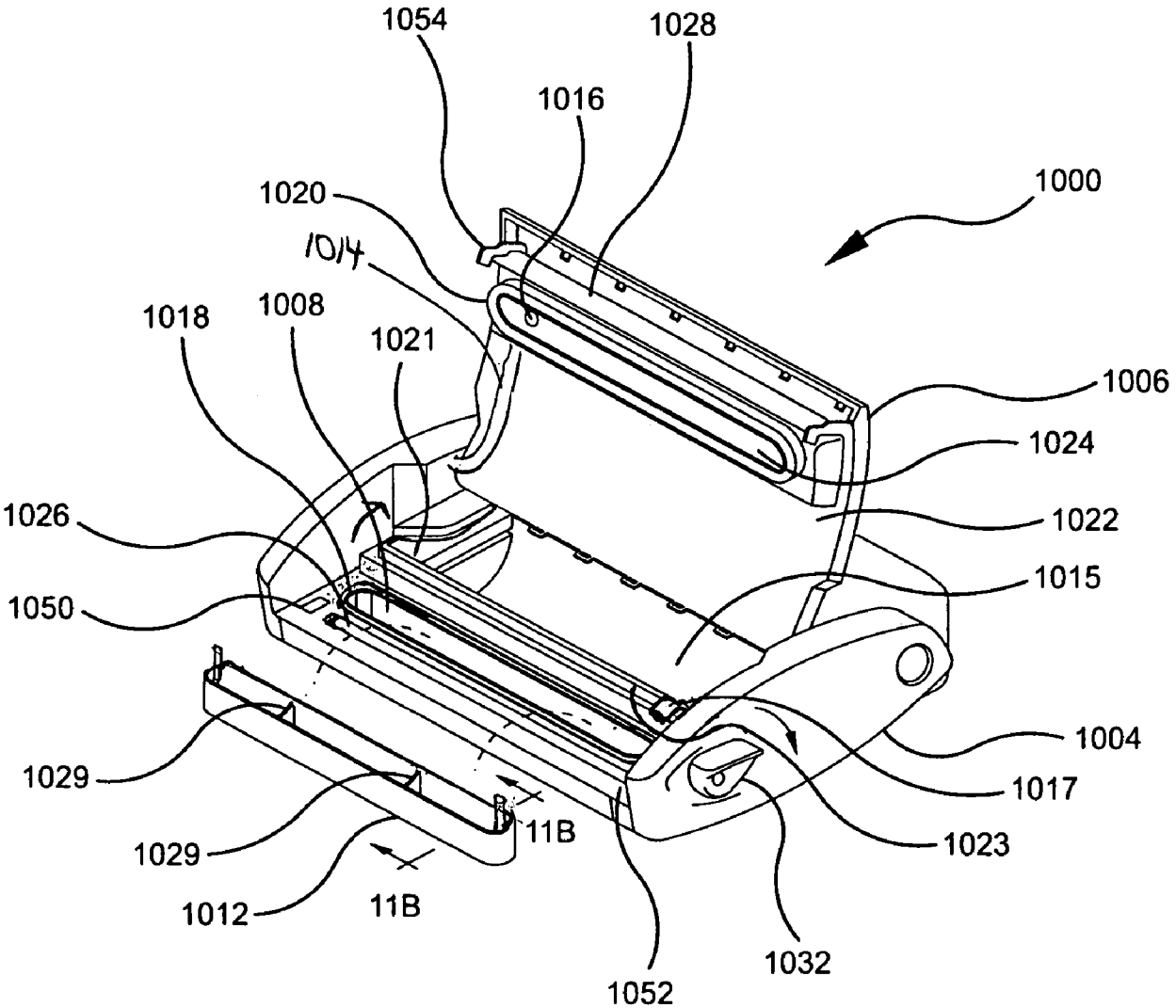
FIG. 11A is a perspective view of the vacuum appliance of FIG. 10 with the lid in the open position.
Figure 12:
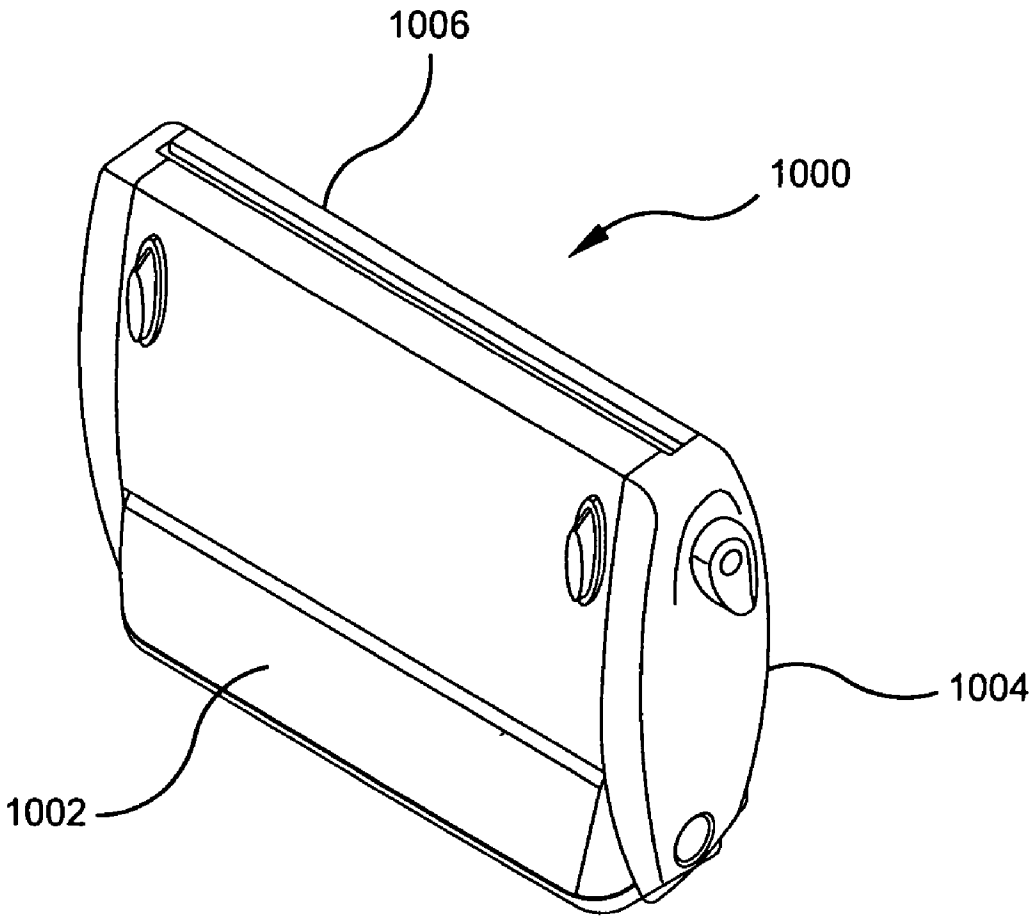
FIG. 12 is a perspective view of the vacuum appliance of FIG. 10 shown in the storage position.
Figure 13:
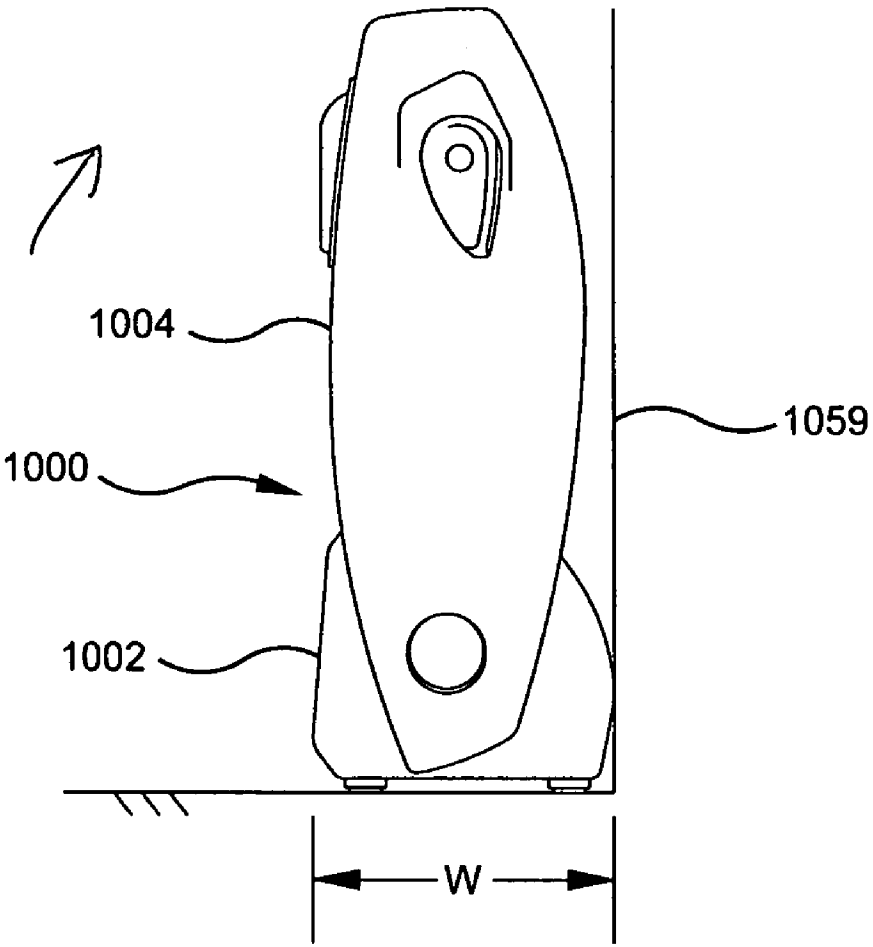
FIG. 13 is a side elevational view of the vacuum appliance of FIG. 10 shown in the storage position.

An alternative preferred embodiment is shown in FIGS. 10-22. With specific reference to FIGS. 10-14, the vacuum sealing device 1000 includes a base 1002 pivotally secured to a receptacle 1004. The base may be moved between an operating (FIG. 10) and a storage position (FIG. 13). The receptacle is adapted for receiving the open end of a bag 1003 to permit the bag to be evacuated and sealed. The receptacle may include a lid 1006 movable between an open and closed position to selectively cover and uncover a receptacle housing 1052.

With specific reference to FIGS. 10 and 11A, below the lid 1006, the receptacle 1004 may include the housing 1052 having a trough 1008 extending along a longitudinal extent of the receptacle. The trough 1008 may be operably connected to a vacuum generating device 1010 and is adapted for receiving the open end of a bag. The vacuum source 1010 may be operably connected to controls 1007 located on the base for controlling the vacuum source. When in a closed position, the lid 1006 clamps the bag to the receptacle 1004 so that the evacuation of the bag may occur. The trough 1008 may be lined with a removable drip tray 1012 for retaining liquids that may be extracted from the bag during evacuation. The vacuum generating device 1010 located in the base 1002 may be operably connected via tubing 1014 to a vacuum port 1016 on the inside of the lid 1006 at a location above the trough. Alternatively, the trough 1008 may include a vacuum port (not shown) in communication with the vacuum source. The receptacle 1004 may further contain a chamber 1015 for holding a roll of bags. A bag cutter 1017 disposed on a pivoting frame 1021 may be provided. Frame 1021 may rotate up and down to permit bag material to be positioned under the track 1023 of the cutter running along the front of the frame.

The trough 1008 may be surrounded by an elastomeric first gasket 1018 which may cooperate with a second elastomeric gasket 1020 located on the under side 1022 of the lid. Second gasket 1020 may surround an elongate depression 1024 in the underside of lid 1022 which includes a vacuum port 1016. The first and second gaskets may adjoin one another in a compressed manner when the lid is in the closed position, to form an air-tight seal around the trough 1008.

A strip-like heating element 1026 of a type known in the art may be located on receptacle 1004 running along the front side of the trough 1008. Heating strip 1026 aligns with resilient strip 1028 disposed along the front of the lid. When the lid 1006 is in the closed position the resilient strip 1028 urges the bag against the heating strip 1026 to assist in affecting a secure seal when the heating strip is energized after the bag has been evacuated.

Figure 11B:
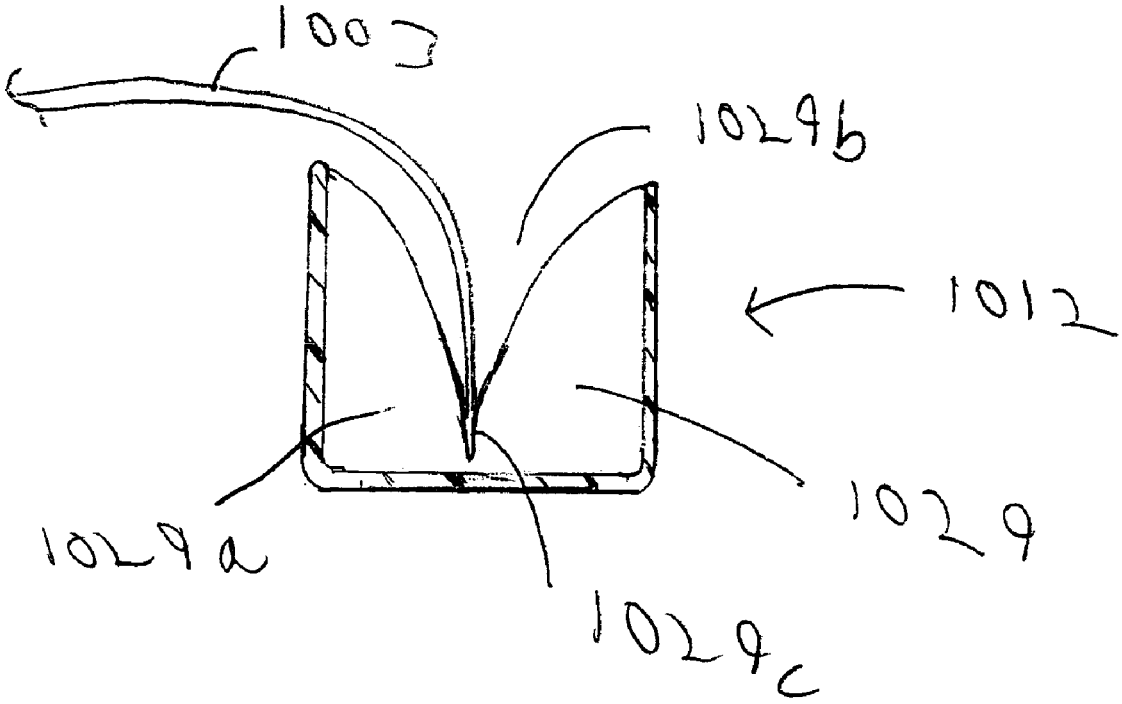
FIG. 11B is a cross-sectional view of the drip tray of FIG. 1I A taken along line 11B-11B thereof.

With reference to FIG. 11B, the removable drip tray 1012 may include one or more bag retainers 1029 disposed therein. Bag retainers may help guide and hold the end of the bag 1003 down in the drip tray 1012 to facilitate evacuation of the bag. Preferably a pair of bag retainers are used and each include a wall 1029*a* having a slot 1029*b* formed therein. The slot tapers to a narrow channel 1029*c* which engages the end of the bag and retains the bag in the proper position for evacuation.

Figure 11C:
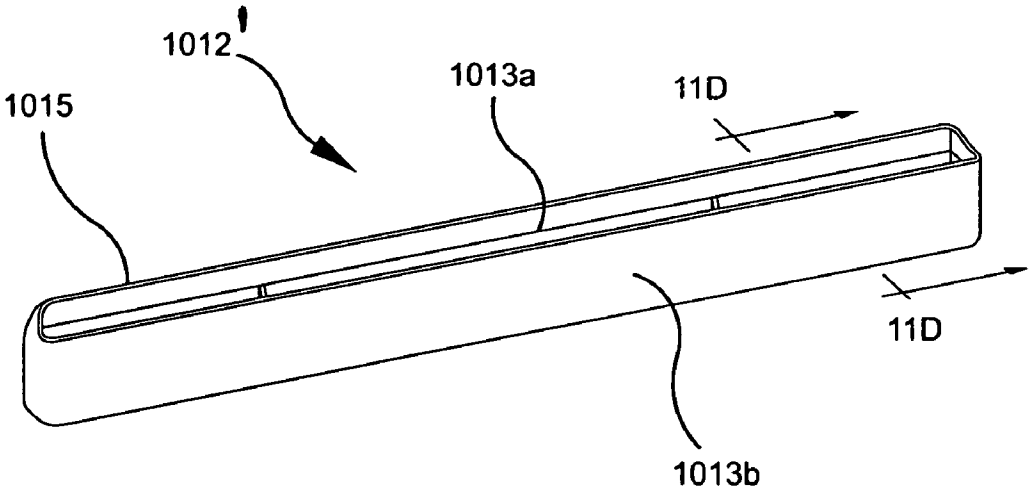
FIG. 11C is a perspective view of an alternative embodiment of the drip tray of the present invention.
Figure 11D:
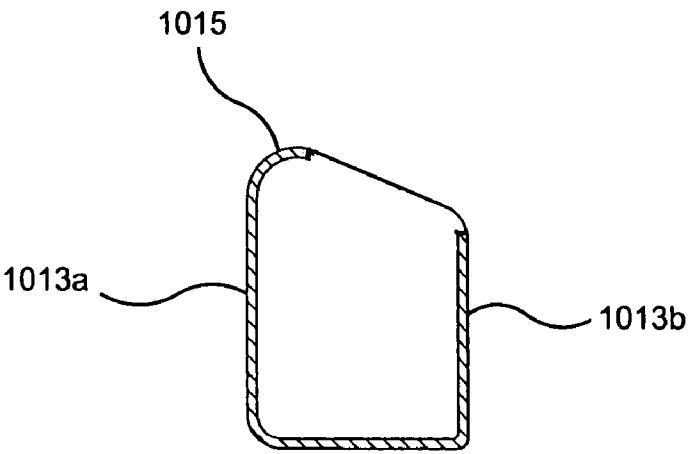
FIG. 11D is a cross-sectional view of the drip tray of FIG. 11C taken along line 11D-11D thereof.

An alternative embodiment of the drip tray 1012 is shown in FIG. 11C. After a bag has been evacuated some liquid may be extracted, and it is collected in the drip tray. While the drip tray may be emptied and cleaned after use, some liquid may still remain in the tray. Therefore, it is desirable to have the drip tray have the ability to retain some liquid when the receptacle is in the storage position. Drip tray 1012' may be formed in a manner similar to that shown in FIGS. 11A and 11B, except that back sidewall 1013*a* may extend above the front sidewall 1013*b* and include a U-shaped cross-sectional lip 1015. When the receptacle is rotated to the storage position, the back wall 1013*a* becomes a bottom wall, and the lip 1015 extends upwardly. Liquid still in the drip tray 1012' will be retained by lip 1015.

Figure 14:
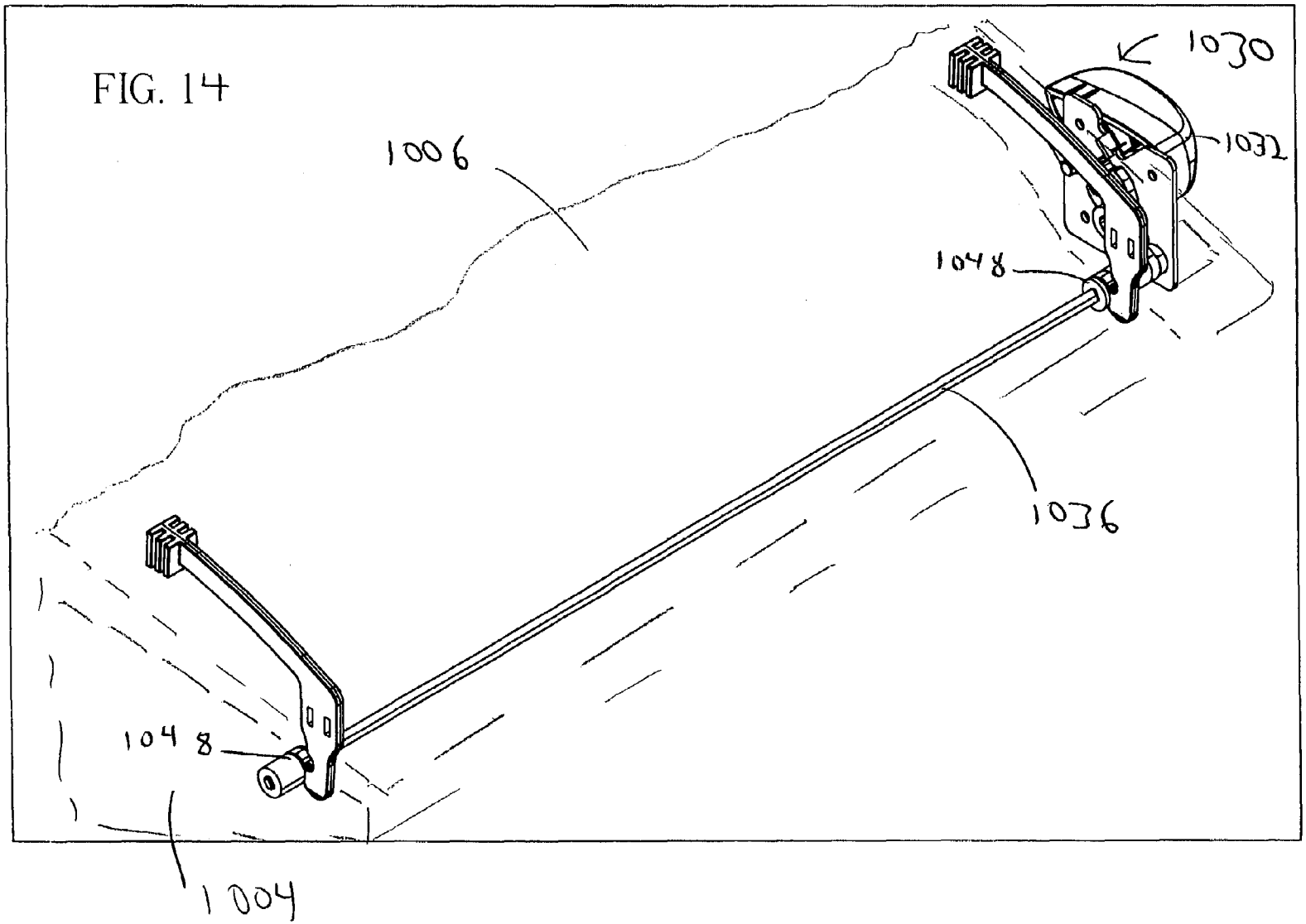
FIG. 14 is a perspective view of the lid latching mechanism of the present invention with the lid and receptacle housing shown in phantom for clarity.
Figure 15A:
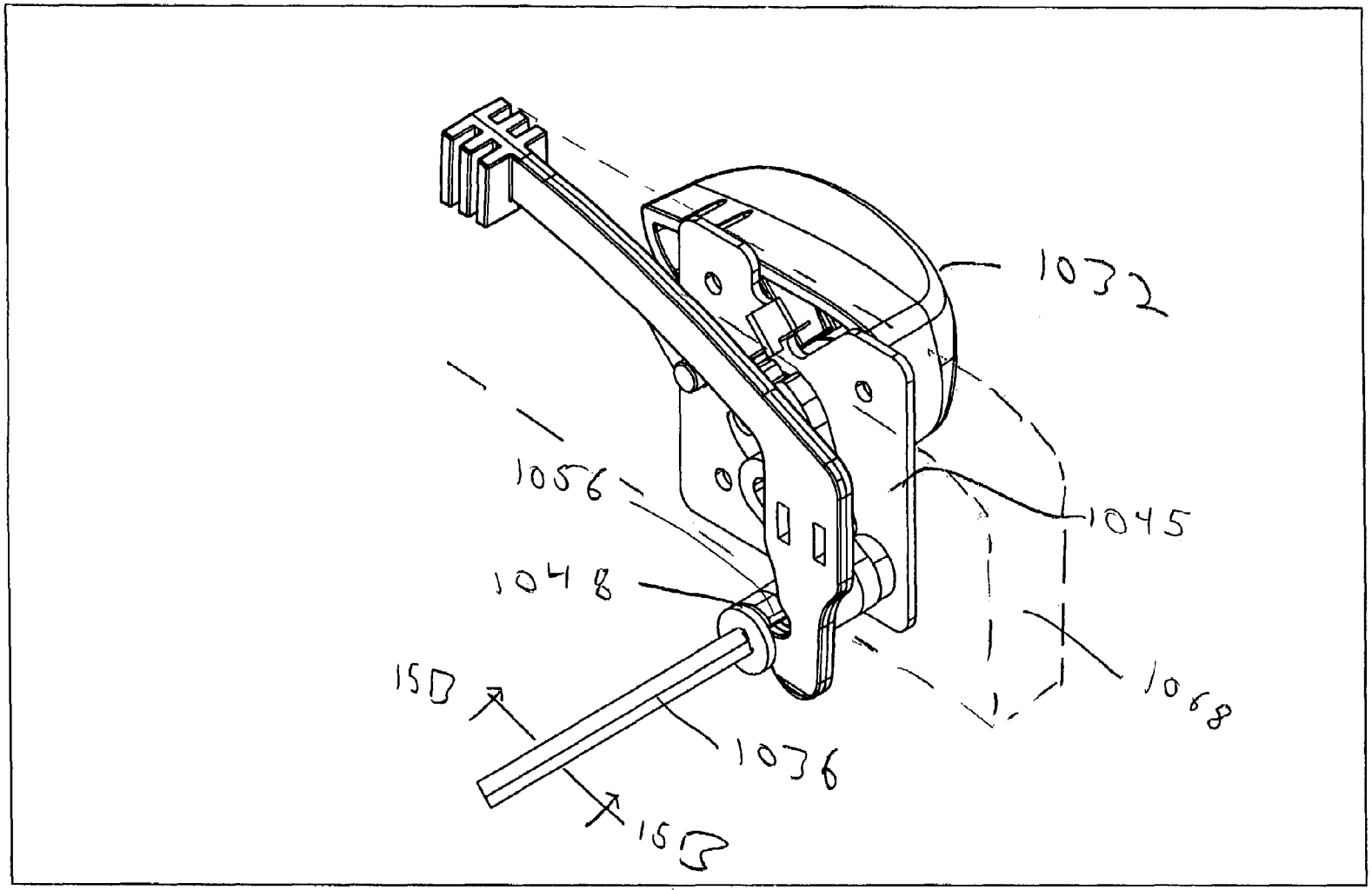
FIG. 15A is a perspective detail view of the latching mechanism of FIG. 14.
Figure 15B:
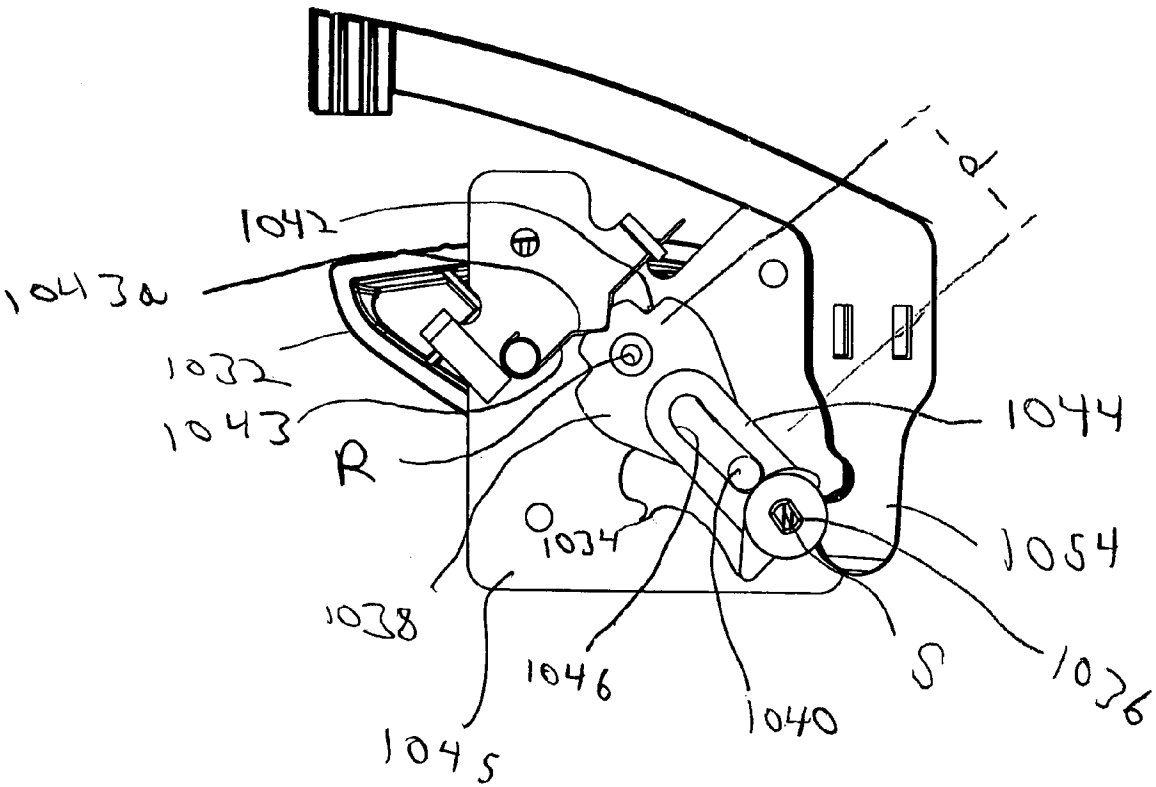
FIG. 15B is a cross-sectional view of the latching mechanism of FIG. 15A taken along line 15B-15B thereof with the lid and receptacle housing removed for clarity.
Figure 16:
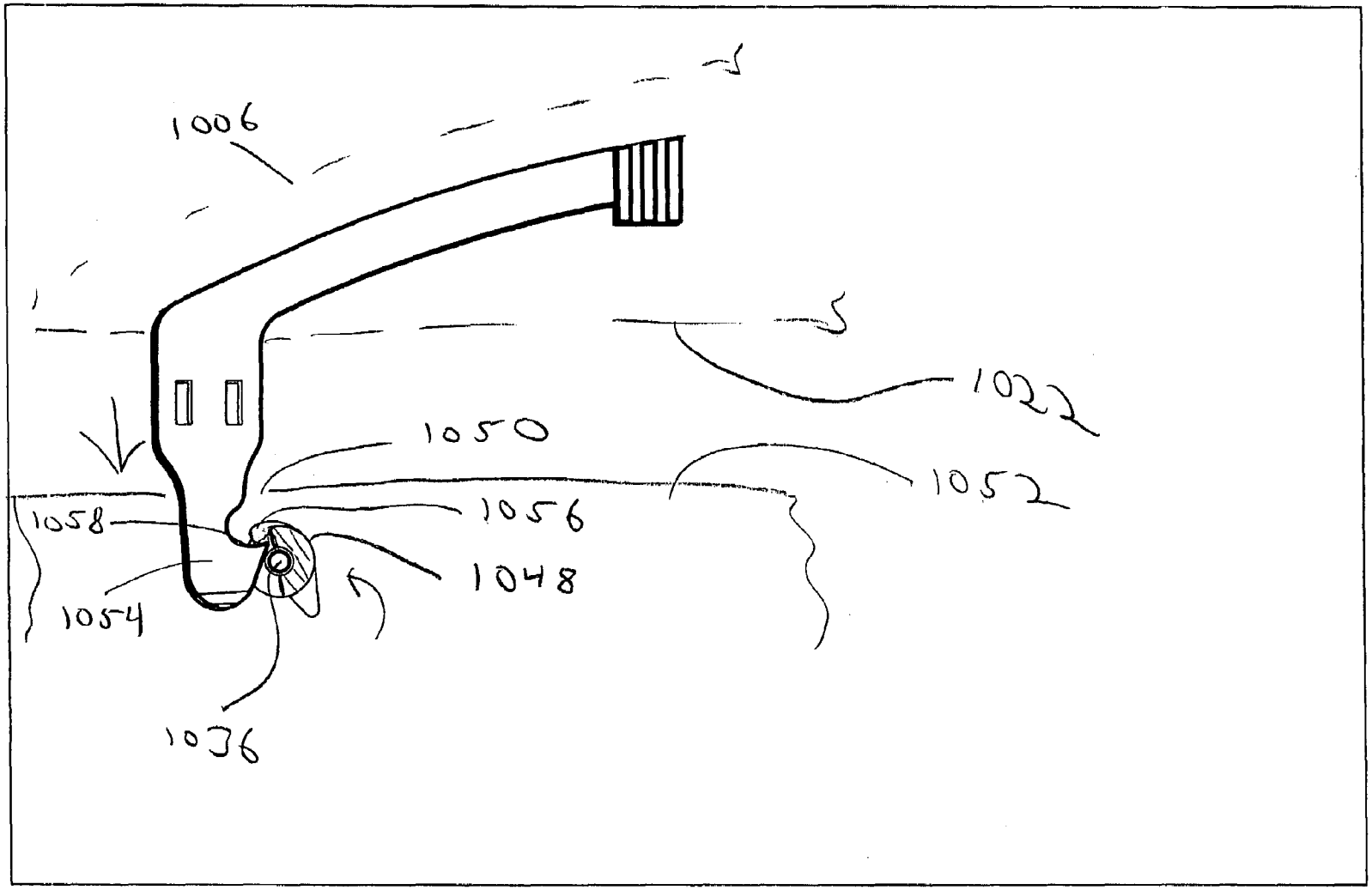
FIG. 16 is a detail elevational view of the latching mechanism engaging the lid with a portion of the latch removed for clarity.
Figure 17:
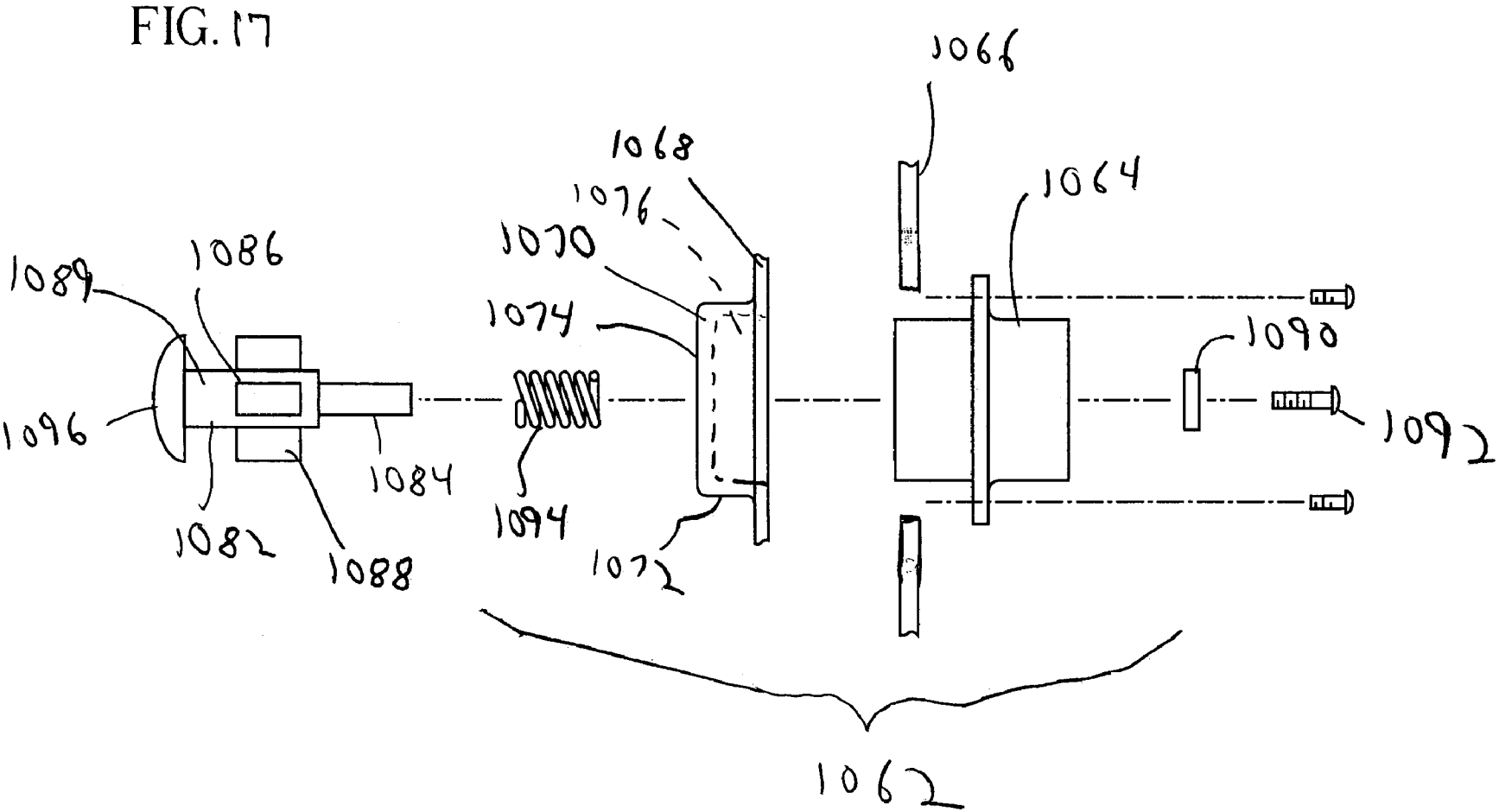
FIG. 17 is an exploded view of a locking hinge of the present invention.
Figure 18:
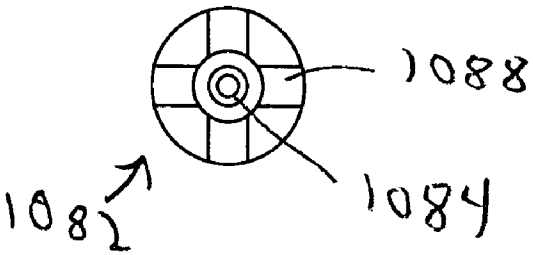
FIG. 18 is an elevational end view of a locking member of FIG. 17.
Figure 20:
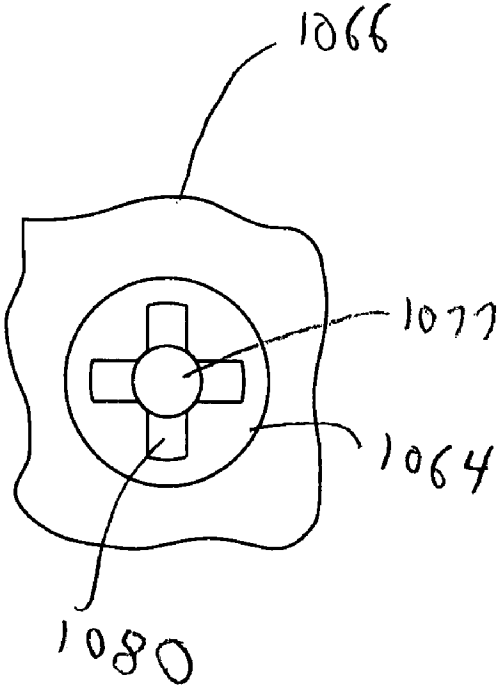
FIG. 20 is an elevational detail view of a component of the locking mechanism on the base.
Figure 19:
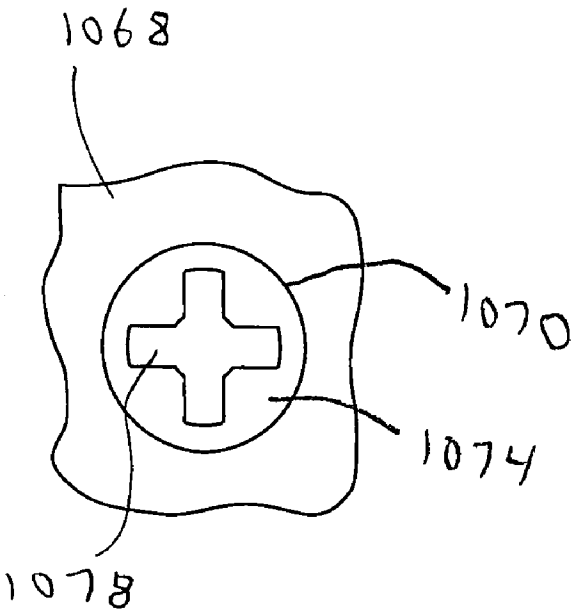
FIG. 19 is an elevational detail view of a component of the locking mechanism on the receptacle.

With reference to FIGS. 14 to 16, the lid 1006 may preferably be secured in the closed position by a latching mechanism 1030. Latching mechanism 1030 permits the lid 1006 to be firmly secured in the closed position such that an air-tight seal is created around the open end of the bag. Latching mechanism 1030 also permits the lid to be retained in a closed position without compressing the gaskets. This is useful when the receptacle is rotated into the storage position. Securement of the lid 1006 may be achieved by a user rotating a latch actuator 1032 located on the receptacle 1004. In the preferred embodiment, the actuator 1032 may be located on the side of the receptacle near the front of the appliance. The actuator 1032, which may be in the form of a lever or knob, may be secured via a linkage 1034 to a shaft 1036. Alternatively, the actuator 1032 may be directly secured to the shaft 1036. Shaft 1036 preferably runs inside the receptacle housing along the front of the receptacle generally below the heating strip.

The linkage 1034 may include a first component 1038 fixedly secured to the actuator 1032. Rotation of the actuator results in rotation of the first linkage component 1038. First linkage component 1038 may have a connecting pin 1040 disposed a distance, d, from an axis of rotation, R, of the actuator 1032. On an end opposite of the pin 1040, first component 1038 may include a plurality of ridges 1042, which may be used to provide discrete detented positions for the actuator. A second linkage component 1044 may have an elongated shape with one end connected to the end of the shaft 1036. The second linkage component 1044 includes an elongated slot 1046 which receives in sliding engagement the pin 1040 of the first linkage component 1038. Rotation of the actuator 1032 causes pin 1040 to rotate and to translate within the slot 1046 resulting in rotation of the second linkage component 1044 and shaft 1036. When the shaft is in its fully rotated position, the pin 1040 may be at the top of the slot 1046 and is at the furthest distance from the axis of rotation, S, of the shaft. The cooperation between the first and second linkage components helps maintain the actuator in the fully secured position and resist the force of the gaskets 1018 and 1020 which are compressed in this position.

With regard to the detent feature of the present invention, a resilient member 1043 may include a V-shaped portion 1043*a* that rides within one of the ridges 1042 of the first linkage component 1038. The resilient member 1043 may be secured at each end to a plate 1045. Plate 1045 is secured to a sidewall of the receptacle 1048 (FIG. 15A). The plate may also rotatably support the actuator and first linkage component 1038. When the actuator 1032 is turned, the resilient member deflects and snaps back into the next ridge, thereby signifying the next position of the actuator 1032 and retaining the actuator in that position. In the preferred embodiment, three discrete detented positions are provided.

Shaft 1036 includes a pair of spaced catches 1048 secured thereto. Catches 1048 are located below slots 1050 (FIG. 16) formed in adjacent opposite ends of the receptacle housing 1052. Slots 1050 are sized and spaced to receive engagement members preferably in the form of hooks 1054 extending downwardly from the underside 1022 of the lid. When the latch actuator 1032 is in the open position, closing the lid causes the hooks 1054 to extend into the slots 1050. With the lid closed and the actuator in the open position, hooks 1054 sit adjacent to catches 1048, but they preferably do not engage each other. Catches 1048 each include a projection 1056 that is engagable with a curved end portion 1058 of hooks. Rotation of the actuator 1032 from a first open position to a second latching position causes the catches 1048 to rotate and engage the hooks 1054 (FIG. 15A). The actuator 1032 may be detented such that upon rotation when the catches have made initial engagement with the hook the user feels a click and the lid 1006 will be held in the closed position. This actuator second position may be used to retain the lid 1006 in the closed position when the receptacle 1004 is rotated into the stored position. Further rotation of the actuator 1032 results in further rotation of the catches 1048 which pulls the hooks 1054 and lid 1006 downwardly such that the first and second gaskets, 1018 and 1020, surrounding the trough 1008 are compressed. This third actuator position, or sealing position, forms the air tight seal for evacuation.

After evacuation and/or sealing is completed, a user may reverse the rotation of the actuator 1032 and fully unlatch the lid 1006 to permit removal of the bag. Accordingly, the actuator may include three discrete positions, open, retained and sealing. The actuator of the present invention permits the lid to be fully secured on both ends, and opened and closed by one operation, i.e., the moving of the actuator 1032.

It is within the contemplation of the present invention that only an open and sealing position may be provided. It is further within the contemplation of the present invention that other types of latching devices, e.g. mechanical and vacuum latches, could be used to secure the lid as is well known in the art.

The vacuum packaging appliance 1000 is rotatable between an operative position and a storage position. In the operative position (FIG. 10), the receptacle is generally horizontal with a support surface such as a countertop. When the appliance is to be stored, the receptacle is rotated upwardly so that it is generally perpendicular to the support surface (FIGS. 10, 12, and 13). In this position the receptacle preferably does not extend beyond the width, W, of the base. Therefore, vacuum sealing appliance 1000 is substantially vertical and may be pushed back against the counter backsplash 1059 for storage. Accordingly, the amount of counter space used is minimal.

With additional reference to FIGS. 10 and 17 to 22, the receptacle 1004 and base 1002 may be pivotally connected by first and second hinges 1060 and 1062 disposed at each end of the base. In the preferred embodiment, the base 1002 and receptacle 1004 may be selectively rotationally lockable so that the two components are fixed with respect to each other such as in the operating and storage positions. Preferably, the locking mechanism may be incorporated into one of the hinges. In the preferred embodiment, the hinge 1062 may be lockable to selectively lock the base with the receptacle to prevent rotation. The locking hinge 1062 may include a tubular part 1064 fixed to a sidewall 1066 of the base. A sidewall portion of the receptacle 1068 may include a round projection forming a cup 1070 including a side wall 1072 and an end wall 1074 forming an interior space 1076. A portion of the tubular part 1064 is received in space 1076 and rotation between the tubular part and the cup 1070 is possible. The end wall 1074 and the inside diameter 1077 of the tubular portion may include matching inner profiles, 1078 and 1080 respectively, (FIGS. 19 and 20) which are non-round. In the preferred embodiment, the inner profiles 1078 and 1080 have a cross-shaped configuration. It is within the contemplation of the present invention that other configurations could be used.

The locking hinge 1062 may further include a locking member 1082 which extends through the cross-shaped inner profiles 1078 and 1080. The locking member 1082 may be moved between a locked and unlocked position. Locking member 1082 is preferably an elongated member including a round post-like end portion 1084. End portion 1084 leads to a profile portion 1086. Profile portion may have a configuration that is complementary to the inner profiles 1078 and 1080. Preferably, profile portion 1086 has a plurality of radially spaced projections 1088 running axially along its perimeter. Projections 1088 are spaced 90 degrees around the perimeter and correspond to the cross-shape (FIG. 18) such that the projections can slide within the shape. Adjacent the profile portion, locking member 1082 has a portion 1089 with a round profile. This round portion 1089 is insertable into the inner profiles and permits rotation of the cup 1070 relative thereto. The locking member is translatable within the cup 1070 and tubular portion 1064. The post-like end portion 1084 extends beyond the tubular portion and may be held in place by a stop 1090 secured to the end of the locking member by a fastener 1092.

The locking member 1082 is biased by a spring 1094 toward a locked position. In this position (shown in FIG. 21), the projections 1088 engage both the inner profile of the cup 1078 and the inner profile of the tubular portion 1080. In this position of the locking member, rotation of the inner profiles 1078 and 1080 relative to the locking member profile portion 1086 is not possible. Since the projections 1088 extend across structures fixed to both the base 1002 and the receptacle 1004, these members cannot move relative to one another and are locked together.

Figure 10:
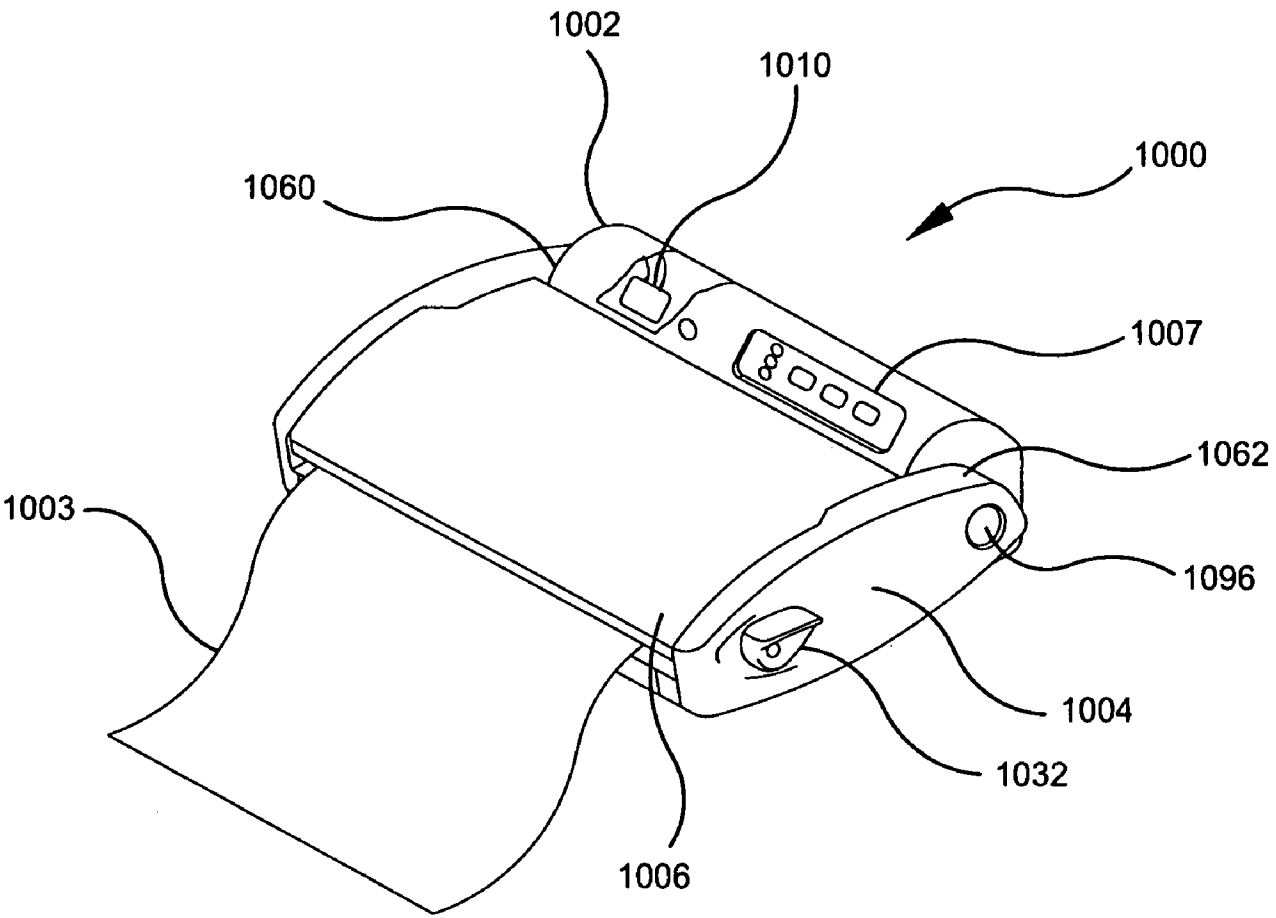
FIG. 10 is a perspective view of still a further alternative embodiment of the present invention shown in the operating position.
Figure 22:
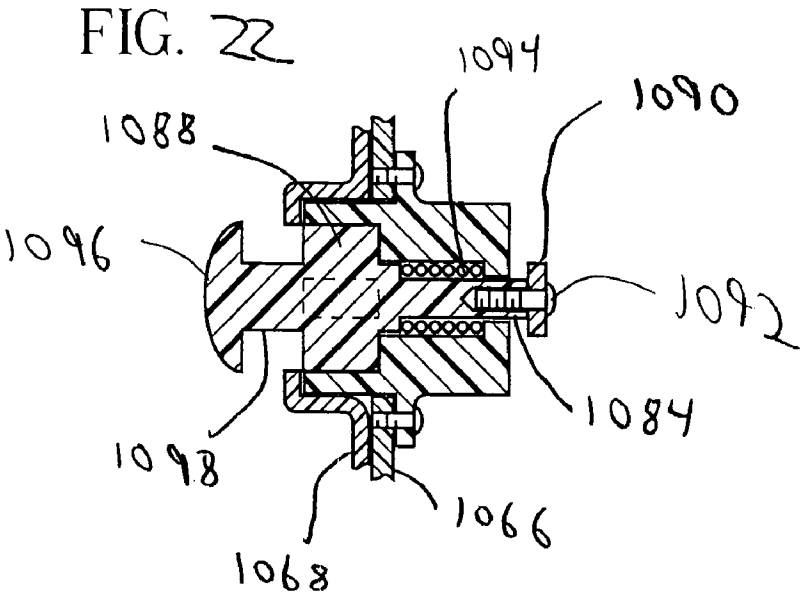
FIG. 22 is a cross-sectional view of the locking mechanism in the unlocked position.
Figure 21:
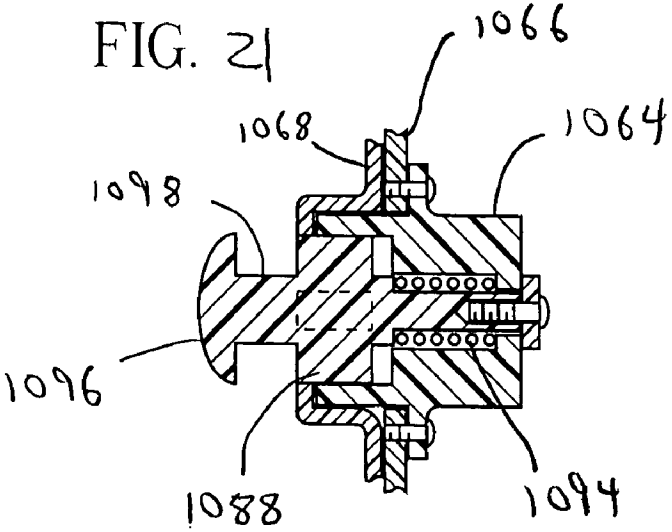
FIG. 21 is a cross-sectional view of the locking mechanism in the locked position.

The locking member 1082 further preferably includes an actuation end, or button 1096, which is accessible on the outer surface of the sidewall of the receptacle as shown in FIG. 10. When this button 1096 is depressed against the bias of the spring 1094, the projections 1088 of the locking member extend past the inner profile 1078 of the cup as shown in FIG. 22. The round part 1089 of the locking member aligns with the inner profile 1078. Rotation of the receptacle 1004 relative to the base 1002 is now possible. Once the receptacle 1004 begins to rotate, the inner profile 1078 of the receptacle projection moves out of alignment with the projections 1088 on the locking member. A user need not hold down the locking member button 1096 since the locking member cannot spring back until the cup inner profile 1078 fixed to the receptacle again aligns with the locking member projections 1088. Such alignment occurs when the receptacle 1004 has rotated approximately 90 degrees such as between the operating position to the storage position. The locking member 1082 moves outwardly and the projections 1088 again span the two inner profiles 1078 and 1080, preventing further rotation.

To move the receptacle from the storage position to the operating position, the user presses in the button 1096, which permits the receptacle to rotate and will continue rotating until it has reached the operating position.

The use of the cross-shaped profile with openings every 90 degrees, permits engagement at 90 degree intervals. It is within the contemplation of the present invention that other non-round profiles, such as a square, could be used to achieve the locking engagement.

It is further within the contemplation of the present invention that other types of latches or detents could be used to allow the receptacle to rotate between various positions and become rotatably locked on those positions.

In the foregoing specification, embodiments of the invention have been described with reference to numerous specific details that may vary from implementation to implementation. The specification and drawings are, accordingly, to be regarded in an illustrative rather than a restrictive sense.

What is claimed is:

1. An apparatus for vacuum sealing a storage bag comprising:

a base for supporting the apparatus on a work surface;

a receptacle for receiving an end of a storage bag, the receptacle including a vacuum chamber for accepting the end of the bag, the receptacle including a housing and a lid pivotally secured to the housing, the receptacle being pivotally secured to the base and rotatable relative thereto between a first and second position;

a vacuum generating device disposed in one of the base or the receptacle; and a sealing device disposed on the receptacle for sealing the end of the bag.

2. The apparatus as defined in claim 1, wherein the base includes controls operatively connected to the vacuum generating device for controlling same.

3. The apparatus as defined in claim 1, wherein the receptacle includes a bag storage compartment.

4. The apparatus as defined in claim 1, wherein the receptacle has an axis of rotation for which is generally parallel to a longitudinal axis of the base.

5. The apparatus as defined in claim 1, wherein the receptacle extends outwardly from the base in a generally horizontal direction when the receptacle is in the first position, and extends in a generally vertical direction when the receptacle is in the second position.

6. The apparatus as defined in claim 1, further including a lock for selectively securing rotation of the receptacle relative to the base.

7. The apparatus as defined in claim 6, wherein the receptacle is pivotally connected to the base by a hinge, and the hinge includes the lock.

8. The apparatus as defined in claim 7, wherein the lock includes a locking member which is movable between a lock and an unlock position.

9. The apparatus as defined in claim 8, wherein the lock further includes a first member secured to the base having a first inner profile and a second member secured to the receptacle having a second inner profile, the locking member having an outer profile being insertable within the first and second profiles, and selectively extending between the first and second profile when in the locked position.

10. The apparatus as defined in claim 9, wherein the locking member outer profile engages on one of the first and second inner profiles when in the unlocked position.

11. The apparatus as defined in claim 1, wherein the vacuum generating device is disposed within the base.

12. The apparatus as defined in claim 1, wherein the receptacle includes a trough in communication with the vacuum generating device.

13. The apparatus as defined in claim 1, wherein the base has a width transverse to its longitudinal axis, and the receptacle does not extend beyond the width of the base when in the second position.

14. The apparatus as defined in claim 1, wherein the receptacle includes a trough surrounded by a resilient material.

15. The apparatus as defined in claim 14, wherein the sealing device includes a heat sealing strip extending along the front of the trough.

16. The apparatus as defined in claim 14, wherein the receptacle includes a lid for selectively covering the trough.

17. The apparatus as defined in claim 1, wherein the base is supportable on a generally vertical surface, and the receptacle is disposed generally parallel to the vertical surface when in the first position and generally perpendicular to the surface when in the second position.

18. The apparatus as defined in claim 1, wherein the receptacle includes a lid movable between an open and closed position.

19. The apparatus as defined in claim 18, wherein the lid is selectively securable in the closed position by a lid latch.

20. The apparatus as defined in claim 19, wherein the lid latch includes an actuator rotatable between a first and second position.

21. The apparatus as defined in claim 20, wherein the lid latch further includes a linkage operably connecting the actuator to a catch, the lid including at least one engagable member, which selectively engages the catch upon rotation of the actuator.

22. The apparatus as defined in claim 21, wherein the catch is movable between a first position which does not engage the lid engagable member, a second position wherein the catch engages the engagable member such that the lid is retained in the closed position, and a third position wherein the catch pulls the lid toward a housing of the receptacle.

23. An apparatus for vacuum sealing a storage bag comprising:

a base;

a receptacle for receiving an end of a storage bag, the receptacle including a vacuum chamber for accepting the end of the bag, the receptacle being pivotally secured to the base by a hinge and rotatable relative thereto between a first and second position;

the hinge including a lock for selectively securing rotation of the receptacle relative to the base, the lock comprising a locking member movable between a lock and unlock position, a first member secured to the base, and a second member secured to the receptacle, the first member having a first inner profile and the second member having a second inner profile, the locking member having an outer profile being insertable within the first and second inner profiles and selectively extending between the first and second inner profiles when in the locked position;

a vacuum generating device disposed in one of the base or the receptacle; and a sealing device disposed on the receptacle for sealing the end of the bag.

24. An apparatus for vacuum sealing a storage bag comprising:

a base;

a receptacle for receiving an end of a storage bag, the receptacle being pivotally secured to the base and rotatable relative thereto between a first and second position, the receptacle including a vacuum chamber for accepting the end of the bag and a lid movable between an open and closed position, the lid being selectively securable in a the closed position by a lid latch, the lid latch including an actuator rotatable between a first and second position and a linkage operably connecting the actuator to a catch, the lid including at least one engagable member, which selectively engages the catch upon rotation of the actuator;

a vacuum generating device disposed in one of the base or the receptacle; and a sealing device disposed on the receptacle for sealing the end of the bag.

25. An apparatus for vacuum sealing a storage bag comprising:

a base engagable with a work surface for supporting the apparatus thereon;

a receptacle component for receiving an end of a storage bag to permit evacuation thereof, the receptacle being pivotally secured to the base and rotatable relative thereto between a first and second position, the receptacle in the first position extending outwardly beyond the base in a generally horizontal direction and in the second position extending outwardly from the base in a generally vertical direction; and a vacuum generating device disposed in one of the base or the receptacle.

26. The apparatus of claim 25, further including a sealing device disposed on the receptacle for sealing the open end of the bag.

27. The apparatus of claim 25, wherein the receptacle includes a trough for receiving the end of the storage bag extending along a portion of a length thereof, and wherein the trough rotates with the receptacle.

28. The apparatus of claim 25, further including a lock for selectively restricting movement of the receptacle relative to the base.

29. An apparatus for vacuum sealing a storage bag comprising:

a base for supporting the apparatus on a work surface;

a receptacle component for receiving an end of a storage bag to permit evacuation thereof, the receptacle being pivotally secured to the base and rotatable relative thereto between a first and second position, in the first position, the receptacle and base occupying a first amount of work surface and in the second position the receptacle and base occupying a second amount of work surface which is less than the first amount; and a vacuum generating device in one of the base or the receptacle.

30. The apparatus as defined in claim 29, wherein the receptacle extends beyond the base and along the work surface in the first position.

31. The apparatus as defined in claim 30, wherein the receptacle when in the second position extends above the base and generally perpendicular to the work surface.

32. The apparatus as defined in claim 29, wherein the receptacle includes a trough for receiving the end of the storage bag, the trough extending along a length of the receptacle and being in fluid communication with the vacuum generating device.

33. The apparatus as defined in claim 29, wherein the receptacle includes a lid and housing and the lid is movable between an open and closed position, the receptacle further including a lid latch that selectively secures the lid in an open position, wherein the lid is movable from the closed to the open position, an engaged position, wherein the lid is restricted from moving from the closed position to the open position, and a clamped position, wherein the lid is urged toward the receptacle housing.

34. An apparatus for vacuum sealing a storage bag comprising:

a base for supporting the apparatus on a work surface;

a receptacle for receiving an end of a storage bag, the receptacle including a vacuum chamber for accepting the end of the bag, the receptacle being pivotally secured to the base and rotatable relative thereto between a first and second position, and wherein the base is supportable on a generally vertical surface, and the receptacle is disposed generally parallel to the vertical surface when in the first position and generally perpendicular to the surface when in the second position;

a vacuum generating device disposed in one of the base or the receptacle; and a sealing device disposed on the receptacle for sealing the end of the bag.

* * * * *